US006250025B1

(12) United States Patent
Darby

(10) Patent No.: US 6,250,025 B1
(45) Date of Patent: Jun. 26, 2001

(54) ASSEMBLEABLE COLUMBARIUM TOWER

(75) Inventor: James W. Darby, Danville, IL (US)

(73) Assignee: Greenwood, Inc., Danville, IL (US)

( * ) Notice: Subject to any disclaimer, the term of this patent is extended or adjusted under 35 U.S.C. 154(b) by 0 days.

(21) Appl. No.: 09/565,609

(22) Filed: May 4, 2000

(51) Int. Cl.[7] ..... E04H 13/00

(52) U.S. Cl. ..... 52/137; 52/142; 52/732.3; 52/651.01

(58) Field of Search ..... 52/136, 128, 129, 52/133, 134, 137–139, 142, 732.3, 732.1, 730.5, 732.2, 586.1, 654.1, 651.01, 651.07, 653.2, 655.1, 36.2; 211/191, 190, 189, 85.16, 85.27, 188, 186

(56) References Cited

U.S. PATENT DOCUMENTS

| | | | | |
|---|---|---|---|---|
| 3,529,730 | * | 9/1970 | Thompson | 52/136 |
| 4,277,924 | | 7/1981 | Chimentin . | |
| 4,521,999 | | 6/1985 | Flanagan . | |
| 4,607,417 | | 8/1986 | Hancovsky . | |
| 5,134,758 | | 8/1992 | Christnesen . | |
| 5,381,591 | | 1/1995 | Ponger et al. . | |
| 5,477,594 | | 12/1995 | LePage . | |
| 5,740,637 | | 4/1998 | Snow . | |
| 5,881,505 | | 3/1999 | Larkin, III et al. . | |
| 5,899,045 | | 5/1999 | Giannarelli . | |

* cited by examiner

*Primary Examiner*—Beth A. Stephan
*Assistant Examiner*—Naoko Slack
(74) *Attorney, Agent, or Firm*—Gifford, Krass, Groh, Sprinkle, Anderson & Citkowski, P.C.

(57) ABSTRACT

An assembleable repository tower for holding individual quantities of burial remains including a platform base and a first plurality of four upwardly extending and elongate members. Each of the first members further includes a webbed configuration defining an axially extending and substantially hollowed interior. A second plurality of elongate members are second to selected faces of first and second of the first plurality of members. Each of the second members are assembled with the first members so that the tower is of a specified height and establishes four upwardly extending sides. A plurality of niche members are engageable with each of the upwardly extending sides, each of the niche members including a plurality of receptacle portions recessed inwardly from the associated side and which are suitable for holding a quantity of burial remains. Covering fascia are secured to each of the sides of the tower for sealing the niche members and interred burial remains and are further capable of being disengaged from the tower to reveal a selected niche member.

27 Claims, 15 Drawing Sheets

ASSEMBLEABLE COLUMBARIUM TOWER

BACKGROUND OF THE INVENTION

1. Field of the Invention

The present invention relates generally to free standing and tiered burial construction assemblies and, more particularly, to a quickly and efficiently assembleable columbarium or niche tower capable of enclosing and holding, in a permanent and dignified manner, a great plurality of individual burial remains and more particularly cremated remains.

2. Description of the Prior Art

The prior art is well documented with numerous examples of freestanding burial niche and mausoleum structures, the purpose for which being to provide multiple and multi-tier burial enclosures for both cremated and non-cremated remains. The provision of such structures makes possible the storage of large numbers of burial caskets, crematory urns and the like.

A first example of a free-standing, prefabricated cremation memorial is set forth in U.S. Pat. No. 5,881,505, issued to Larkin, III et al. and which teaches a base member prefabricated of aluminum framework and including a first plurality of underground chambers. An upright framework is supported on the base and includes a further large plurality of niches. The base member is supported on concrete footings and further is constructed as a three-dimensional framework to provide support for the upright portion of the memorial.

U.S. Pat. No. 5,477,594, issued to LePage, teaches a niche panel/modular urn holder and which teaches niche panels utilized for the top, bottom and side surfaces of the niche and being connected together by corner connectors that slidably connect to the ends of the panels in a snap-fit manner. The panels each further include two panel members which are snap-fit together to provide for the hollow panel. Metal strips may be added along the perimeter of each panel between the hollow halves of the members to provide extra rigidity to the panel frame. Each of the panels is molded to contain recesses to allow shelves to slidably engage within the recesses to subdivide the niche into smaller compartments.

U.S. Pat. No. 5,899,045, issued to Giannarelli, teaches a mausoleum construction formed from a plurality of crypt structures, each having a generally tubular plastic crypt liner surrounded at side, roof and floor portions thereof by set concrete. U.S. Pat. No, 5,134,758, issued to Christensen, teaches a niche construction and method including a wall of reinforced concrete which has a surface with recesses formed therein, the recesses having openings which extend to the surface. Box liners of non-combustible plastic material have fiberglass fibers disposed therein and are respectively disposed within the recesses. An adhesive adherent to the liner and the concrete is disposed on the exterior surface of the liner and the interior of the recess and forms a bond between the box liner and the reinforced concrete to prevent removal of the box liner.

SUMMARY OF THE PRESENT INVENTION

The present invention is a quickly and easily assembleable columbarium and, more specifically, a crematorium niche repository tower for holding individual quantities of burial remains in an aesthetically dignifying and permanent fashion. The advantages imparted by the assembleable repository tower of the present invention include the strength and relatively light weight of the assembleable components, as well as the provision of additional and variable covering fascia to adapt the look and presentation of the tower to specific tastes. The repository tower is specifically suited for being transported in a portable fashion, such as on a two wheel cart, and is easily assembleable in both indoor and outdoor locations by an individual working alone.

The niche tower includes a substantially planar shaped and platform base having a selected thickness and an upwardly facing surface. One preferred embodiment contemplates the base being provided as a separate piece of concrete or granite which is properly supported upon a ground location. In an alternative embodiment, the platform is incorporated into the floor of a surrounding structure such as a burial mausoleum or the like.

A first plurality of elongate members are provided and which include first, second, third and fourth elongate extending faces in cross section. Each of the faces further includes a pair of first and second spaced apart and lengthwise extending and recessed channels formed therein. A first end of each member engages with the platform base and a second end extends upwardly. Anchoring of the first elongate members is facilitated in one embodiment by the provision of angled floor plates for engaging the first ends upon the upwardly facing surface of the platform base. Each of the first plurality of members further includes a webbed configuration as viewed in cross section and which defines an axially extending and substantially hollowed central interior, such that the weight associated with the elongate members is greatly reduced without any significant impact to their structural capabilities.

A second plurality of elongate members, each of the second plurality of members having first and second oppositely extending ends from which project axially extending screws, the screws are aligned with a recessed channel selected from each of a pair of spaced apart and first elongate members. Each of the second members also includes first, second, third and fourth, elongate extending faces in cross section, each of the faces further including a lengthwise extending and recessed channel formed therein. A similar webbed configuration in cross section may be provided in lengthwise extending manner for each of the second elongate members, provided the ends of the second members support the axially extending screws through a centerline of the second member.

Once positioned in aligning fashion with the recessed channels of the first elongate members, each second member is rotated in a tightening direction to secure the second member in a cross wise extending fashion between the pair of first elongate members. In this fashion, the second plurality of elongate members is assembled in cross wise extending fashion and at selected vertical locations between the first vertically extending members so that the tower of a specified height is constructed and establishes first, second, third and fourth upwardly extending sides in cross section. The preferred embodiment of the invention also contemplates the use of an 8020 aluminum extrusion in the first and second elongate members and which, in combination with the webbed cross sectional configuration of the elongate members, significantly reduces the weight of the underlying tower frame without any appreciable degradation of its structural load bearing characteristics.

In a further preferred variant, the axially extending screws of the second and crosswise extending elongate members may be replaced by angled and substantially "L" shaped brackets for securing respective ends of the cross members at specified vertical locations to the vertically upwardly extending members. In a yet further embodiment, the cross members are held in a compressed and fixed manner by additional cross wise extending compression bars. Each of the compression bars include appropriately shaped ends for slidably engaging within rearward and parallel extending recessed channels of the pair of extending channels in each of the first plurality of elongate extending members. The compression bars extend in parallel and spaced fashion relative to the second cross wise members and the compression bars may further be located in cross sectional and interconnecting fashion proximate the upwardly extending end of the constructed columbarium (niche tower). Additional such compression bars may be arranged in interconnecting fashion at intermediate and/or lower ends of the upwardly extending members.

A plurality of niche members are engageable with each of four upwardly extending sides established by the constructed tower. The niche members each including a substantially rectangular outline defined by a peripherally extending lip, opposite and vertically extending edges of the peripheral lip slidingly engaging between selected lengthwise extending and recessed channels of the first elongate members and opposite and horizontally extending edges of the lip being received within the recessed channel of associated with each of the second elongate members. Each of the niche members further include first, second, third and fourth receptacle portions recessed inwardly from the associated side of the tower to which it is secured and are suitable for holding numerous quantities of burial remains.

A plurality of individual covering fascia pieces are secured to each of the four sides of the tower in overlaying fashion relative to their associated niche members and for the purpose of sealing the niche members and their interred burial remains. Mounting plates are provided at specified vertical locations to planar and spaced apart faces of selected pairs of the first extending members. The mounting plates are secured, respectively, to the faces of the first extending members by twist and lock fasteners extending through slots formed in the mounting plates an which are in alignment with the selected portions of the axially extending channels of the selected pair of first elongate members.

A flange extends from each of the mounting plates and includes an interiorly threaded and integrally formed sleeve portion. Flanges associated with upper and lower mounted plates provide locating and abutting engagement to a positioned fascia piece, and additional mounting bolts are provided, each having an enlarged head, an exteriorly threaded and extending shaft and a washer slidably engaged upon the shaft. The exteriorly threaded shafts of the mounting bolts engage the sleeve portions of the mounting plates, and the upper and lower corresponding edges of the fascia plates each further include "V" shaped notches in alignment with the positioning of the projecting sleeve portions to facilitate the installation of the covering fascia.

A top is placed upon the upwardly extending and assembled end of the elongate members defining the tower. In a preferred embodiment, first and second planar shaped pieces of fascia material, such as granite, are provided. The first and second pieces each have a selected thickness and are placed atop the tower in abutting fashion. A third planar shaped piece of fascia material of a selected thickness is placed atop the first and second abuttingly engaged pieces and has a length and width less than a combined length and width of the first and second pieces.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
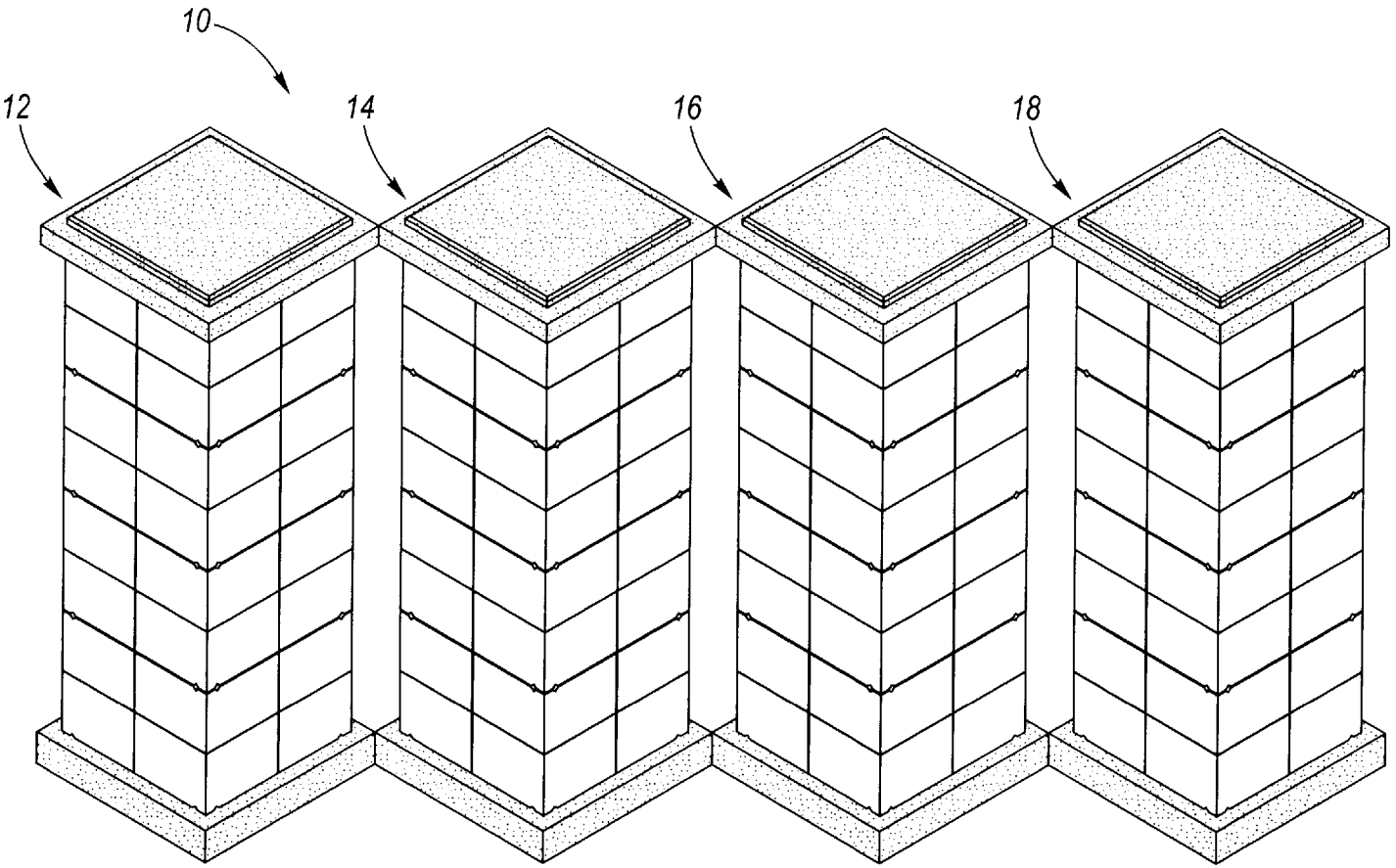
FIG. 1 is a perspective view of the niche tower in assembled fashion and with a plurality of such towers arranged in one arrangement according to the present invention.

Referring now to FIG. 1, a perspective view is illustrated at 10 of a columbarium, or niche tower, arrangement according to one variant of the present invention. The arrangement 10 illustrates first, 12, second 14, third 16 and fourth 18 assembleable niche towers in a multiple and decoratively arranged fashion. While illustrating one arrangement employing a number of niche towers, it is understood that other variations and designs of one or more towers can be instituted without departing from the scope of the instant invention. It is contemplated that the assembleable columbarium tower can be transported in a portable fashion, such as upon a dolly or a two-wheeler, and may be assembled by one or more individuals in either an indoor or an outdoor location. Additionally, the overall size and dimension of the assembleable niche tower can also be easily modified within the scope of the invention. The above said, a detailed description of the construction of a selected assembleable and niche/repository tower will now be made.

Figure 2:
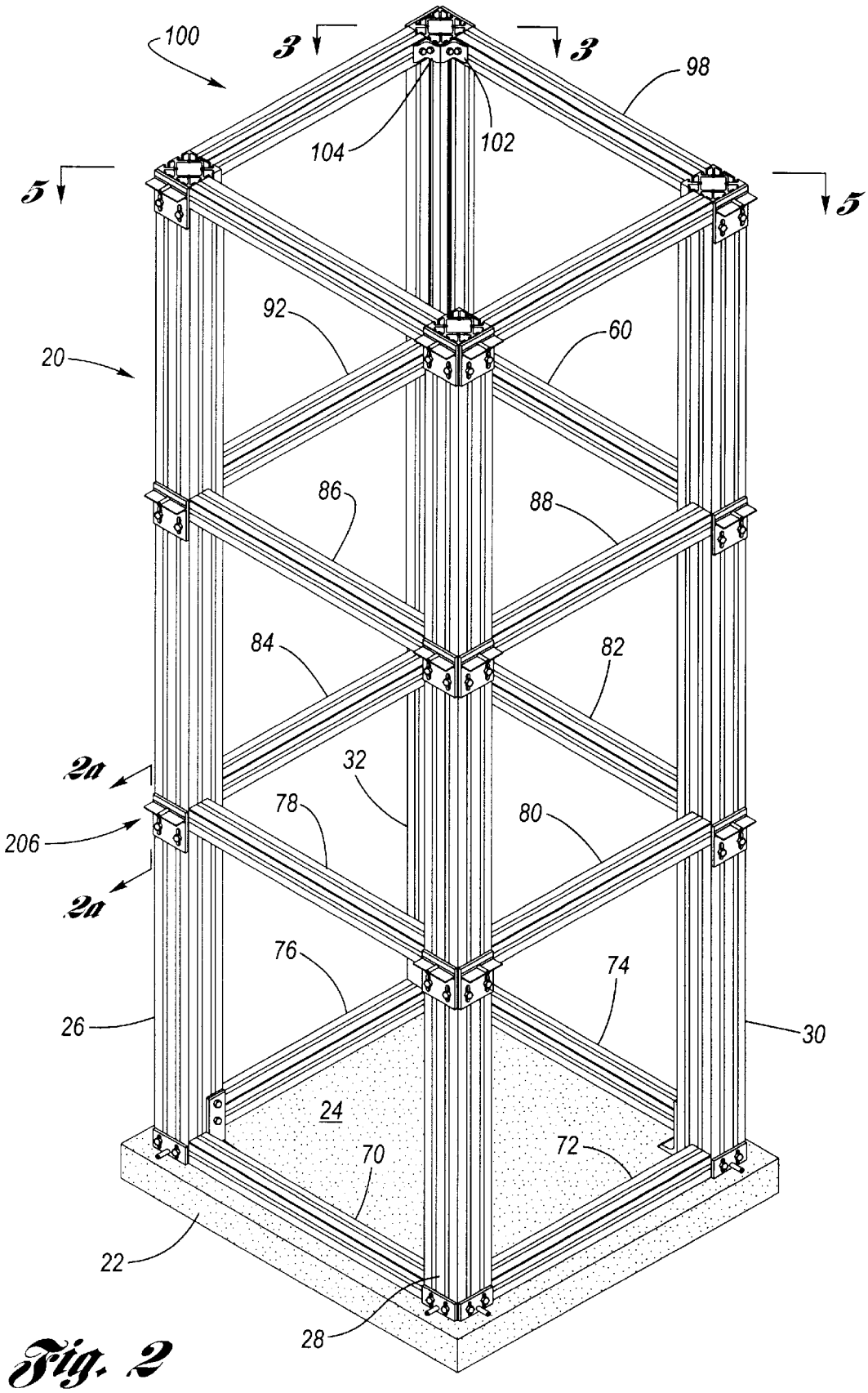
FIG. 2 is a perspective view of the first and second pluralities elongate members defining the assembled frame upon the platform and according to the present invention.

Referring to FIG. 2, an assembleable frame is illustrated at 20 forming a part of the repository tower according to the present invention. The frame 20 includes a substantially planar shaped platform base 22, typically constructed of a cement or granite material, and having a selected thickness and an upwardly facing surface 24. One preferred embodiment contemplates the base being provided as a separate piece of concrete or granite which is properly supported upon a ground location. In an alternative embodiment, the platform is incorporated into the floor of a surrounding structure such as a burial mausoleum or the like.

A first plurality of first 26, second 28, third 30 and fourth 32 elongate members are provided, each of which includes first, second, third and fourth elongate extending faces in cross section. A first end of each member engages with the platform base 22 and a second end extends upwardly and in a generally vertical direction a selected height from the base 22. The elongate members are anchored in place upon the upwardly facing surface 24 by angled floor plates. Specifically, and referring to FIGS. 12 and 13 in combination, pairs of angled floor plates 34, 36, 38 and 40 are provided, respectively, for securing the lower ends of each of the elongate members 26, 28, 30 and 32. Referring specifically to the enlarged sectional view of FIG. 12, pair of angled floor plates 36 are illustrated in perspective relative to the lower extending end of the second elongate extending member 28. The angled floor plates are each constructed in an substantially "L" shape and further include the provisions of bolts (such as are illustrated at 40 and 42 in FIG. 12) for securing the respective legs of the associated plates to the platform base upper surface 24 and the associated sides of the selected vertical elongate extending member 28. It is also contemplated that other fastening mechanisms can be employed for securing the angled floor plates to both the platform base 22 and the vertically extending and first elongate extending members 26, 28, 30 and 32.

Figure 12:
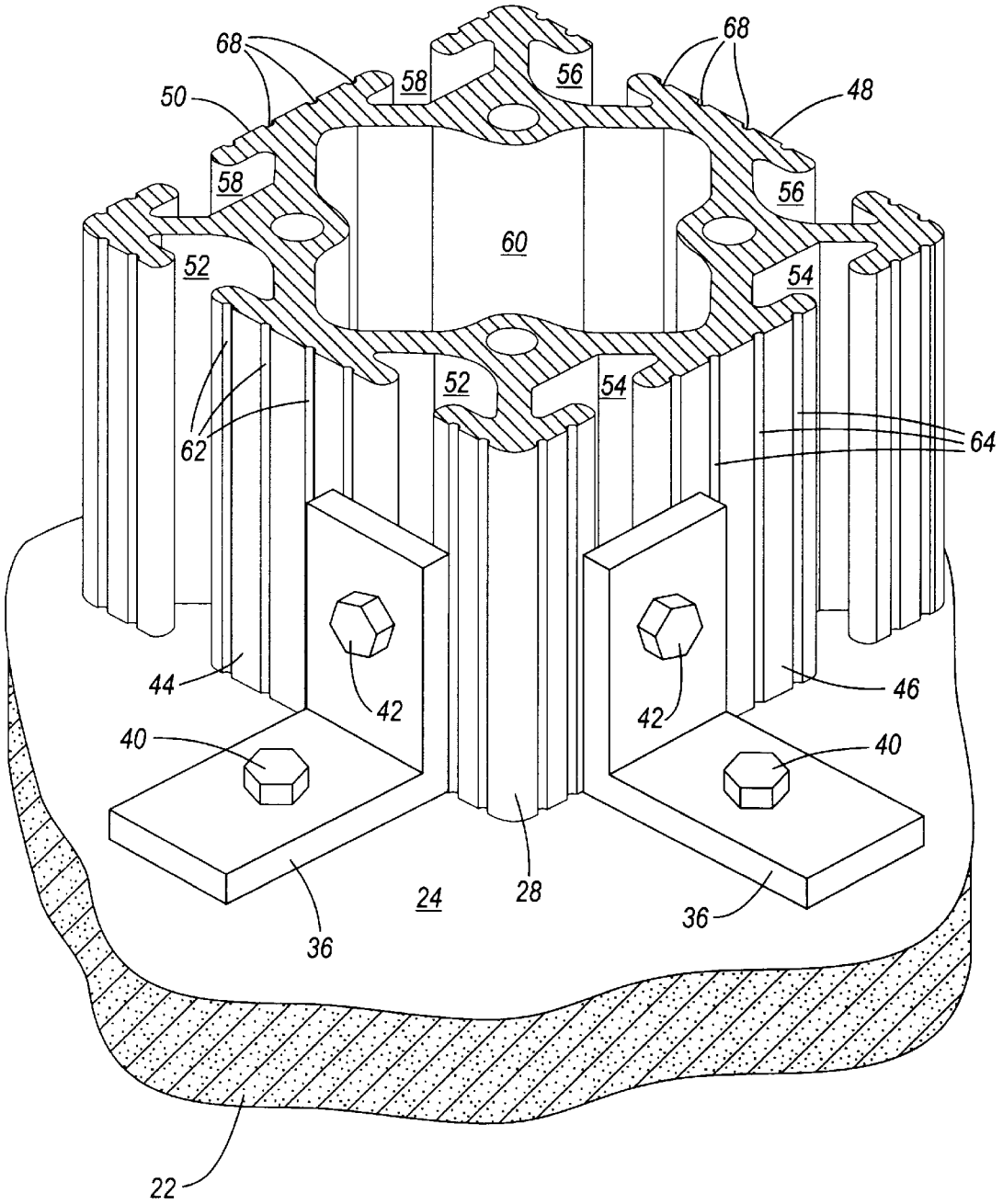
FIG. 12 is an enlarged sectional view in perspective illustrating a first lower end of a selected vertical extending member which is anchored upon the platform base by angled floor plates.
Figure 13:
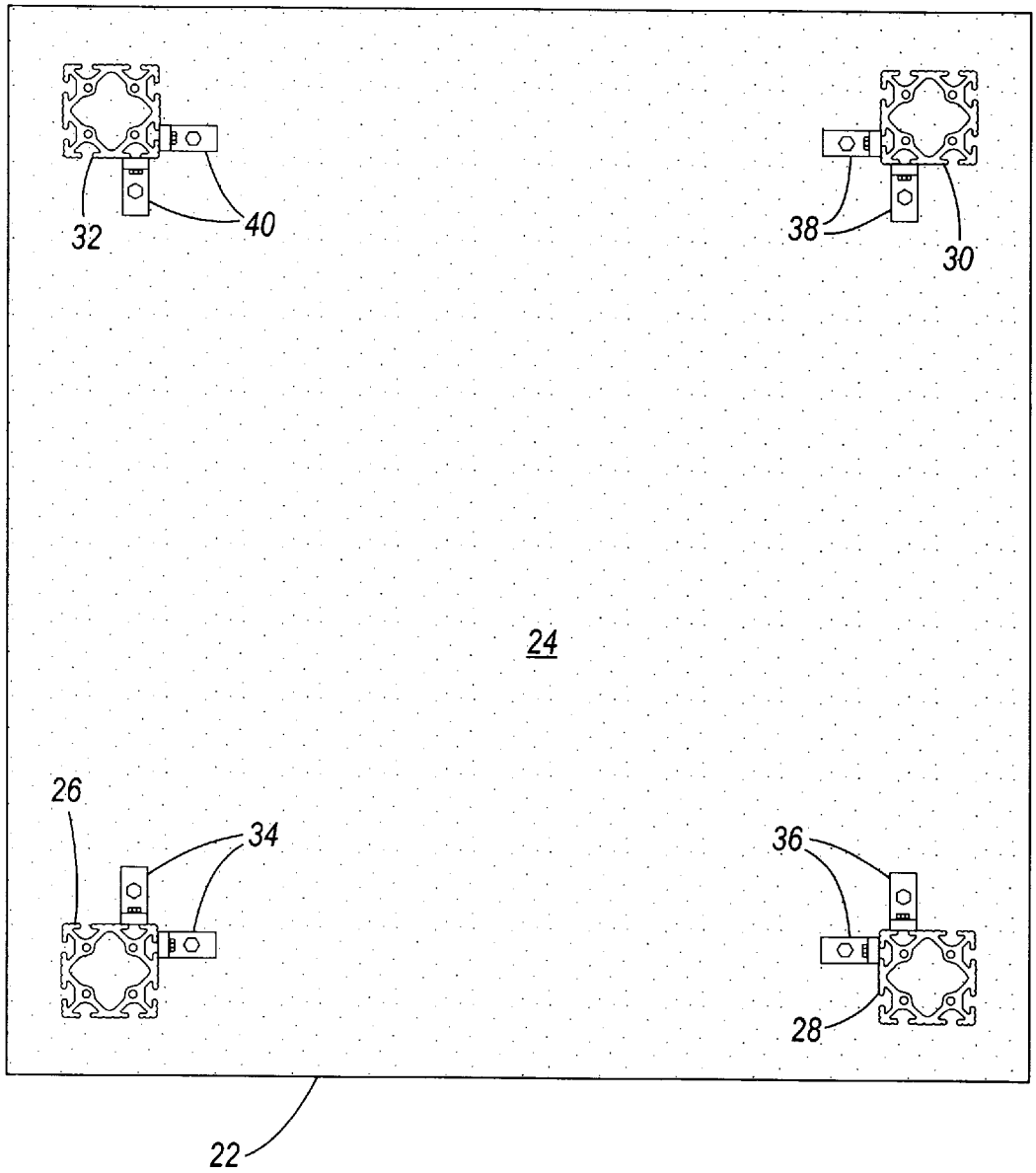
FIG. 13 is a top view of the platform base and illustrating the first plurality of elongate members secured by the angled floor plates according to the present invention.

As is best illustrated again in FIG. 12, the second vertically extending member 28 is illustrated with first 44, second 46, third 48 and fourth 50 elongate extending faces. The other vertically extending members 26, 30 and 32 each illustrate an identical four sided and cross sectional structure according to the preferred embodiment, such that a repetitious disclosure of them is unnecessary. It is also envisioned that the vertically extending members 26, 28, 30 and 32 can be of any other suitable polygonal shape in cross section, ranging from a three sided triangular shape to an infinite number of sides in cross section, thus approaching a circular configuration.

Referring again to FIG. 12, each of the faces 44, 46, 48 and 50 of the second vertically and elongate extending member 28 further includes a pair of first and second spaced apart and lengthwise extending and recessed channels configured within the associated faces. Specifically, pairs of recessed channels 52, 54, 56 and 58 are provided, respectively, for each of the faces 44, 46, 48 and 50. As is further clearly shown, the inner recessed and lengthwise extending surfaces defining the respective channels are further configured by a generally enlarged or "mushroomed" shaped configuration, the purpose for which will be subsequently described.

Each of the first plurality of members 26, 28, 30 and 32, as again best illustrated by the enlarged sectional view of the second vertically extending member 28 in FIG. 12, further includes a webbed configuration as viewed in cross section and which defines an axially extending and substantially hollowed central interior (see at 60), such that the weight associated with the elongate members is greatly reduced without any significant impact to their structural capabilities. It is contemplated that the elongate extending members 26, 28, 30 and 32 are constructed of a durable and relatively lightweight material, such as an aluminum extrusion commercially designated as 8020 aluminum so as to form the elongated and internally hollowed web configuration with the appropriate planar faces, stippling marks (see at 62, 64, 66 and 68, respectively extruded into faces 44, 46, 48 and 50) and recessed pairs of channels 52, 54, 56 and 58.

Figure 2A:
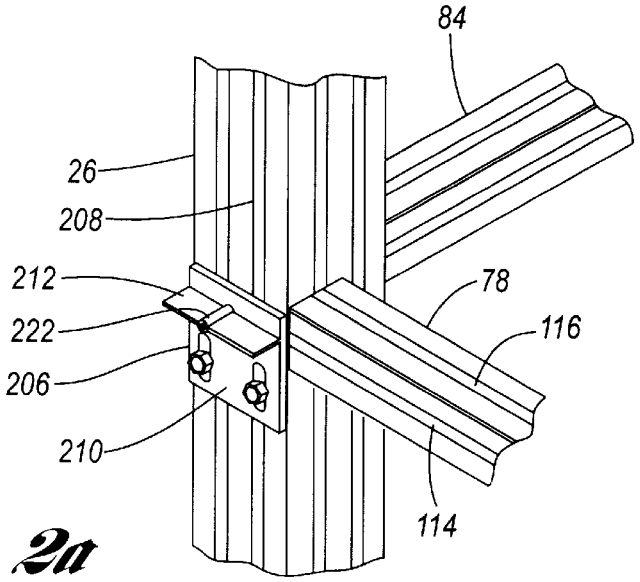
FIG. 2*a* is an enlarged sectional view in perspective taken along line 2*a*—2*a* of FIG. 2 and illustrating a selected connection between a first elongate vertically extending member, with a separably engaged fascia mounting plate, and a second cross wise extending and elongate extending member.
Figure 2B:
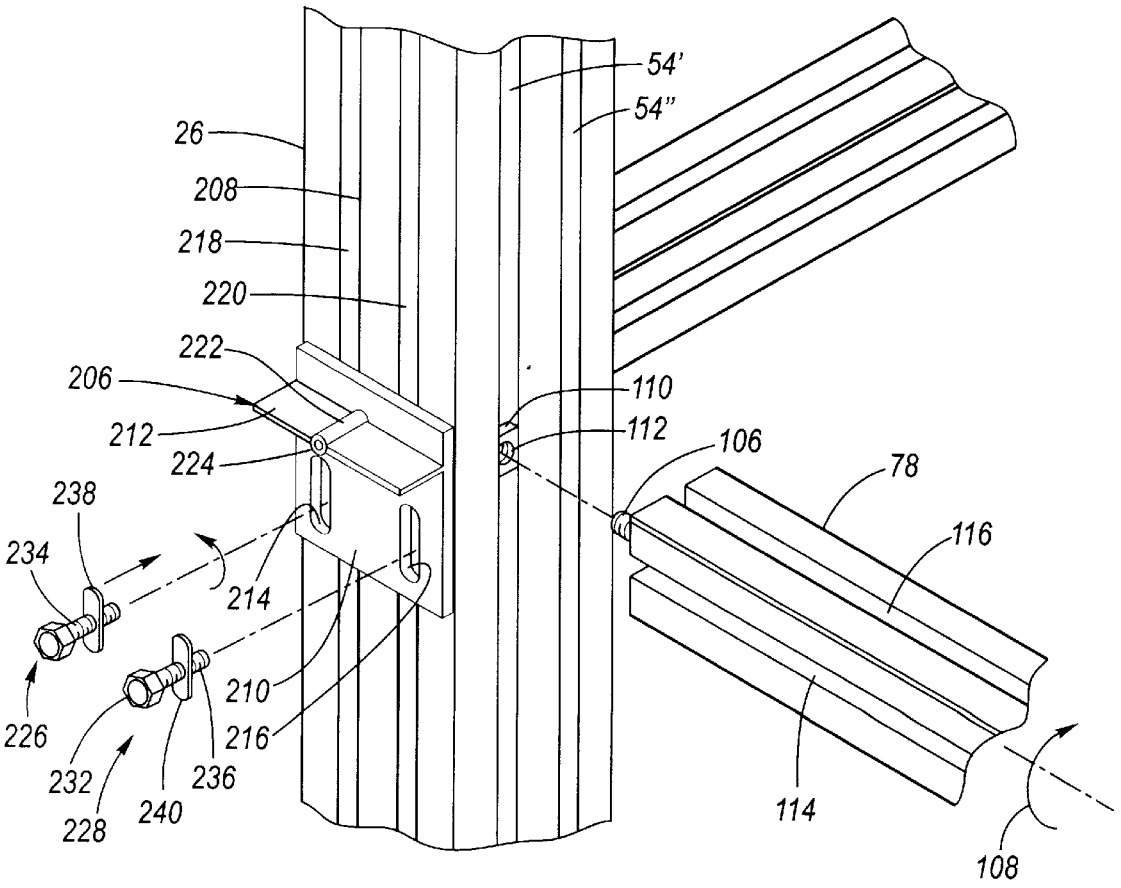
FIG. 2*b* is a further enlarged and exploded view of the illustration of FIG. 2*a* and illustrating the manner in which the selected second cross wise extending member and the mounting plate are respectively engaged with the first vertically extending member.

Referring now to FIGS. 2, 2*a* and 2*b*, a second plurality of elongate members are provided, each of these functioning as crosswise extending and reinforcing members to the four upwardly extending and first plurality of elongate members 26, 28, 30 and 32. As is specifically illustrated in FIG. 2, four levels of cross wise extending members are illustrated for interconnecting the four spaced apart and vertically upwardly extending members 26–32. Specifically, a first group of four crosswise elongate extending members 70, 72, 74 and 76 are assembled in extending fashion between associated pairs of the first members 26–32 proximate the platform base 22 at the point where the first members 26–32 are secured by the angled floor plates. A second group of the crosswise extending members 78, 80, 82 and 84 are illustrated in likewise interconnecting fashion at a first selected vertical location along the upwardly extending elongate members 26–32. A third group of the crosswise extending members 86, 88, 90 and 92 are shown at a further selected vertical location and a fourth group 94, 96, 98 and 100 are finally illustrated at an uppermost vertical location proximate the top of the upwardly extending and elongate members 26–32.

Figure 3:
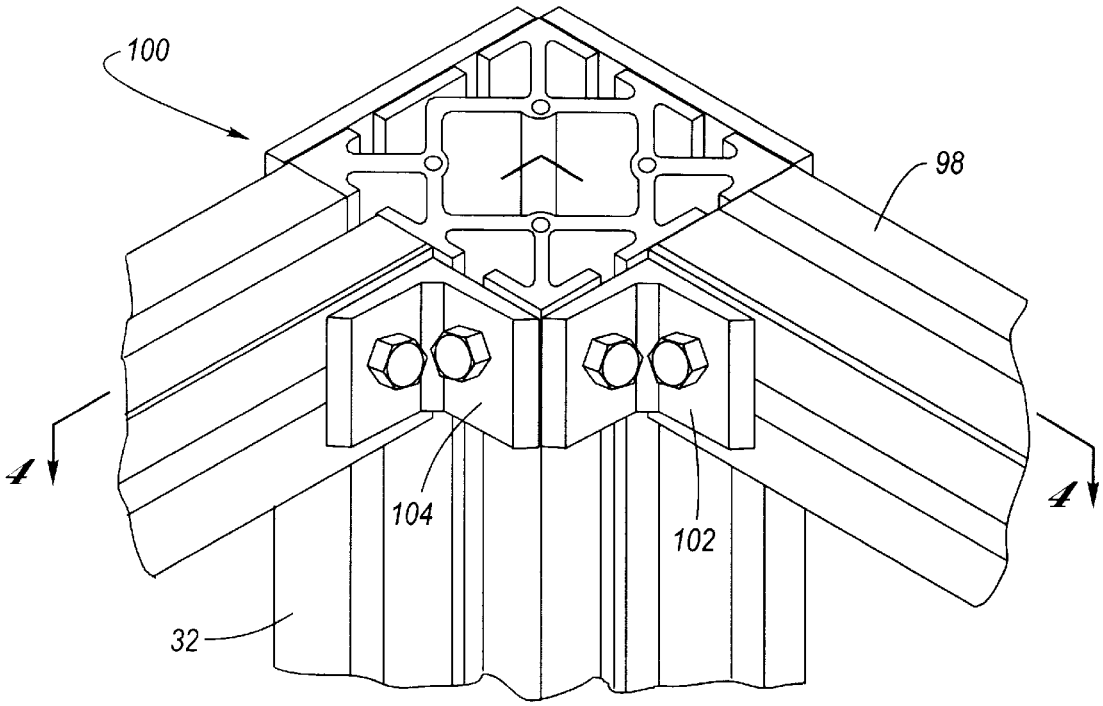
FIG. 3 is an enlarged sectional view in perspective taken along line 3—3 of FIG. 2 and illustrating an upwardly extending end connection between a selected one of the first elongate members and a pair of associated and second horizontally extending members.
Figure 3A:
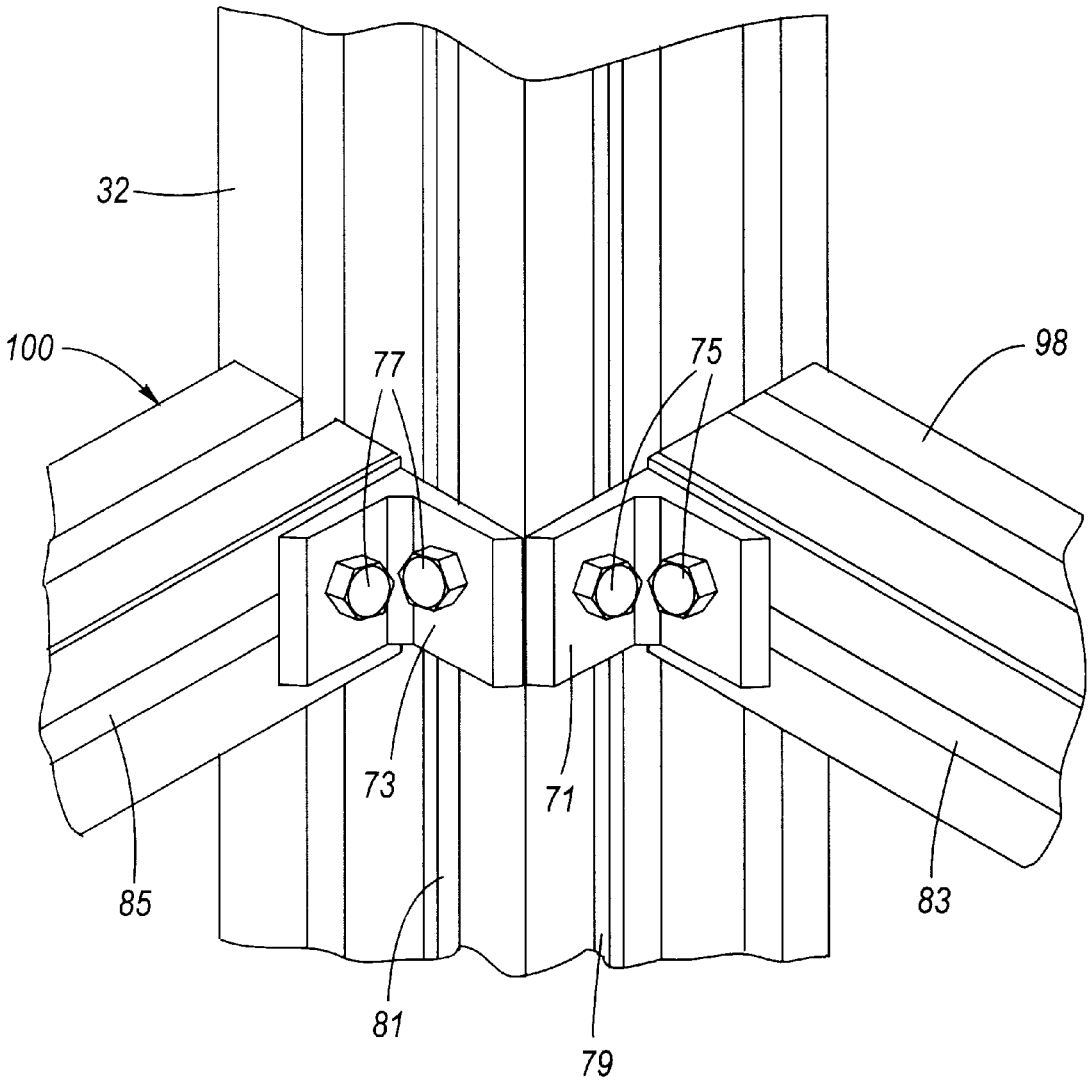
FIG. 3*a* is a further enlarged sectional view of an intermediate location of a selected upwardly extending member and a pair of cross wise extending members and illustrating an alternate manner of interconnecting the cross members to the upwardly extending member according to the present invention.

Referring again to FIG. 2, and also to the enlarged sectional view of FIG. 3, angled brackets 102 and 104 are provided for reinforcing the engagement between the first plurality of upwardly extending members (illustrated by third member 32) and associated and interconnecting second/crosswise extending members (illustrated by upper tier cross members 98 and 100). Referring further to FIG. 3*a*, an alternate variant of engaging the crosswise extending members (illustrated again by members 98 and 100) to a corresponding upwardly extending member 32 is provided by additional angled brackets 71 and 73. The brackets 71 and 73 in FIG. 3*a* are substantially identical in construction to those shown at 102 and 104 in FIG. 3, except that in this illustration they provide the primary or sole means of fastening each and every of the cross members (such as at 98 and 100) at their opposite ends to their associated upwardly extending members (again such as at 32). To this end, first selected bolts of pairs of bolts (75 and 77 for brackets 71 and 73, respectively) are provided and fasten first extending legs of the angled brackets to selected recessed channels (such as 79 and 81) of the upwardly extending member 32. The other of each pair of bolts 75 and 77 secure the other interconnected and angled legs of the brackets 71 and 73 to recessed channels 83 and 85 extending along a selected face or side of the cross members 98 and 100 and so as to secure the cross members 98' and 100' in place to the upwardly extending member 32.

Each of the second plurality of members 70–100, and which is best illustrated by the enlarged, exploded and partial end view of FIG. 2*b* of second cross wise extending member 78, includes first and second oppositely extending ends from which project axially extending screws. Specifically, only a first selected end of the second member 78 is shown and illustrating an exteriorly threaded screw 106 extending axially from its associated end. It is further understood that an identical such screw extends from the opposite and unseen end of the second member 78 and further that identically configured and axially extending screws extend from each of the opposite ends of their associated second cross members 70–100 as is taught by the first preferred embodiment of the instant invention.

The screws of each of the second cross members 70–100, again referenced by screw 106 at associated end of cross member 78 in FIG. 2*b*, is aligned with a recessed channel selected from each of the pair channels (such as again referenced at 52, 54, 56 and 58 in FIG. 12) of the spaced apart and first elongate members 26, 28, 30 and 32. Consistent with the sectional and perspective representation of FIG. 12, recessed and spaced apart channels 54' and 54" are illustrated extending along the face of the vertical extending member 26 opposing the cross member 78 in FIG. 2*b* and which are identical in every respect to those illustrated at 52–56 in FIG. 12.

Once positioned in aligning fashion with the selected recessed channel (in this instance recessed channel 54' of the associated first elongate member 26) the second and crosswise member 78 is rotated in a tightening direction (see arrow 108) to tighten and secure the second member 78 in a cross wise extending fashion between the pair of first elongate members 26 and 28. It is contemplated that the dimension and configuration of the exterior threads placed upon the extending screw portion (see again at 106) are sized in the preferred embodiment so that they may aptly and rotatably engaged with the spaced apart walls defining the flush surface of the associated recessed channel (again at 54') and so that rotation in the tightening direction 108 will tighteningly engage the opposite extending screw portions of the associated cross member in extending fashion between the corresponding and upwardly extending vertical members.

It is also contemplated, in an alternate variant, that a receiving nut 110 or the like may be emplaced within the associated and recessed channel 54', such as by welding or adhesively securing in place, and with the nut 110 further including an interiorly threaded central portion 112 for receiving the corresponding and exteriorly threaded engaging portion of the screw 106 and for assisting in anchoring the cross member in place. As an additional technical note, it is further understood in the preferred embodiment that the arrangement of the threads on an oppositely extending screw portion (to that shown at 106 for cross member 78) must be reversed with respect to those on the screw portion 106 so that (upon rotation of the associated cross member 78) both ends will tighten within their associated vertically extending recessed channels.

Figure 14:
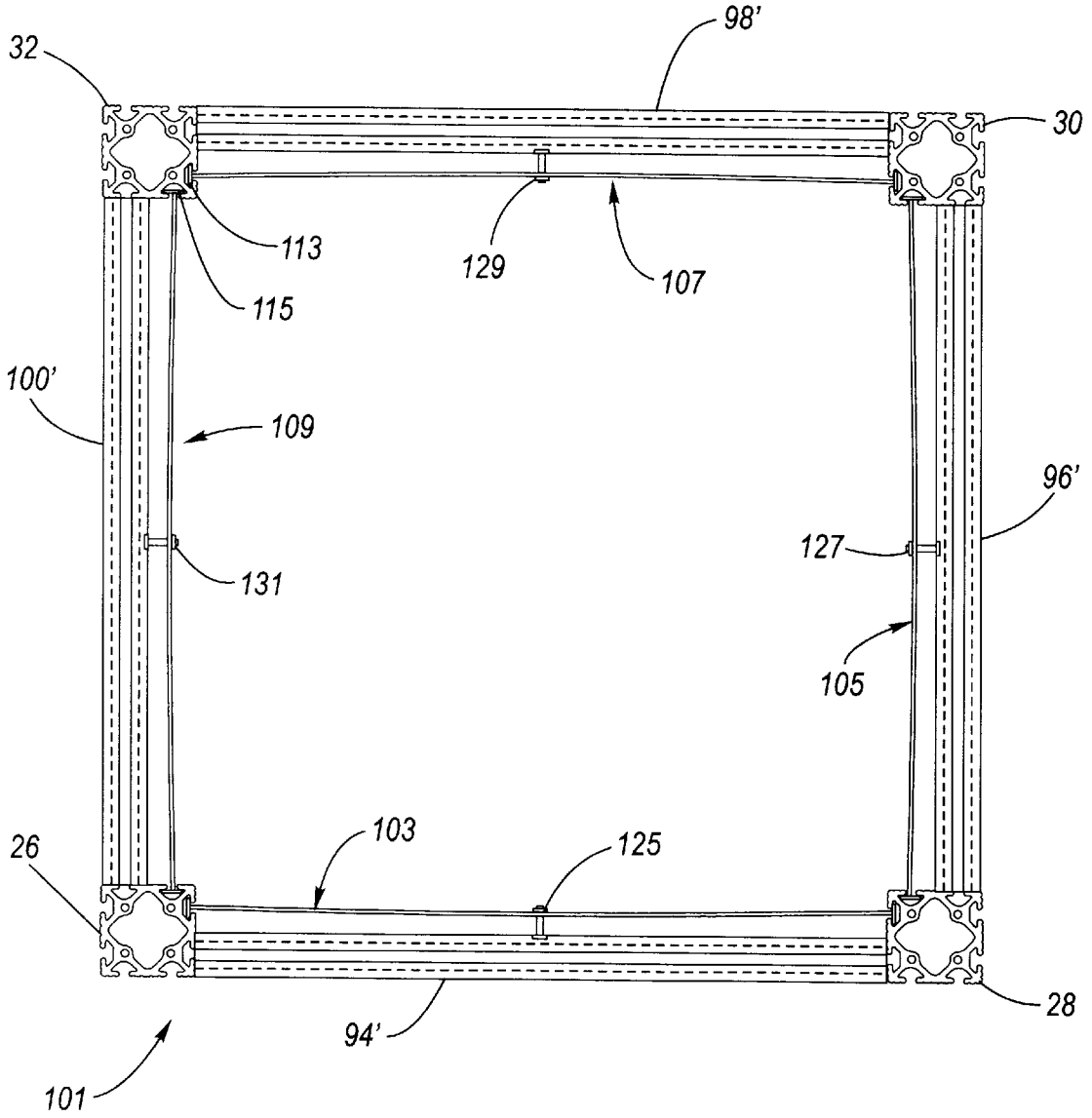
FIG. 14 is a top view illustrating a further preferred manner of interconnecting the crosswise extending members to the upwardly extending members of the assembleable frame and according to the present invention.
Figure 15:
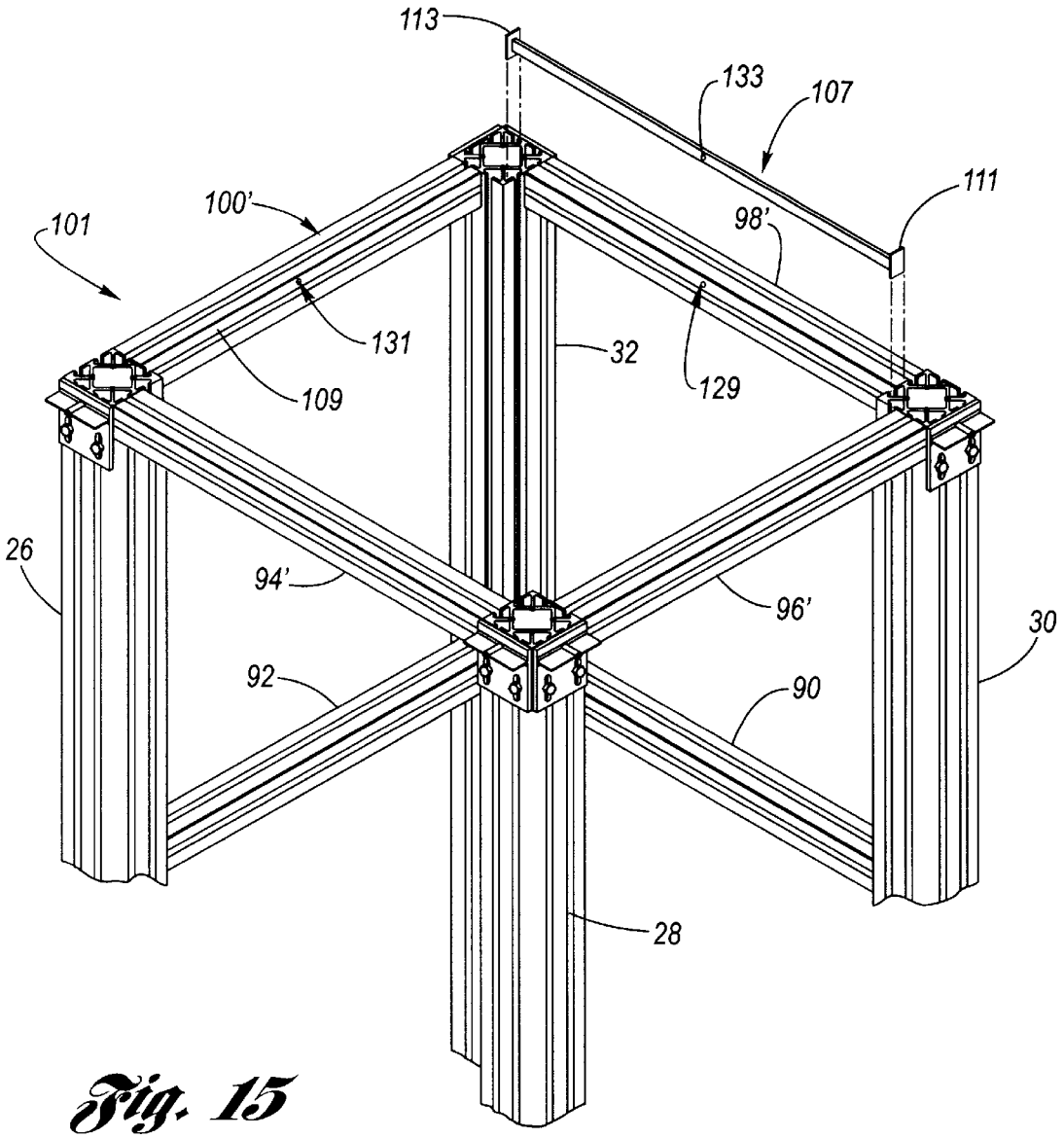
FIG. 15 is a perspective view in upper section of the embodiment shown in FIG. 14 and further illustrating the manner of interconnecting the cross extending members with the upwardly extending members through the use of the additional and crosswise extending compression bars according to the present invention.

Referring to FIGS. 14–17, a further variant of interconnecting the crosswise extending members to the upwardly extending members is illustrated. Specifically, at 101 in FIGS. 14 and 15 is illustrated a top view of the assembly showing a variation of the otherwise interconnecting cross members 94', 96', 98' and 100' interconnecting the four upwardly extending members 26, 28, 30 and 32 and proximate the uppermost end of the assembleable columbarium. Fixed engagement of the cross members is provided by a plurality of additional crosswise extending compression bars which are illustrated at 103, 105, 107 and 109 for cross sectional associated first, second, third and fourth sides of the assembled columbarium tower.

Referring further to FIG. 15, the selected compression bar 107 is illustrated in exploded fashion relative to the assembled columbarium and is constructed as an elongated member having a first bracket end 111 and a second bracket end 113. It is understood that the selected bar 107 is representative of each of the compression bars illustrated and further that each is constructed in a substantially identical fashion. According to one specifically preferred variant, the bars 103–109 may each be constructed of a ⅝" width and a 3⁄16" inch thickness and may further be of any desired overall length suitable for engaging selected recessed channels in the upwardly extending members.

Figure 16:
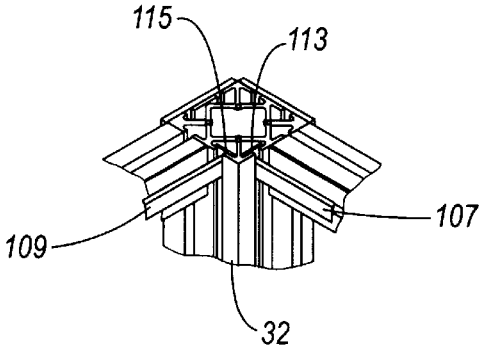
FIGS. 16 and 17 are identical small and enlarged views, respectively, of an interconnecting section taken from FIG. 16 and illustrating the manner in which the crosswise compression bars are installed, between the upwardly extending members and relative to the second plurality of cross members, according to the present invention.
Figure 17:
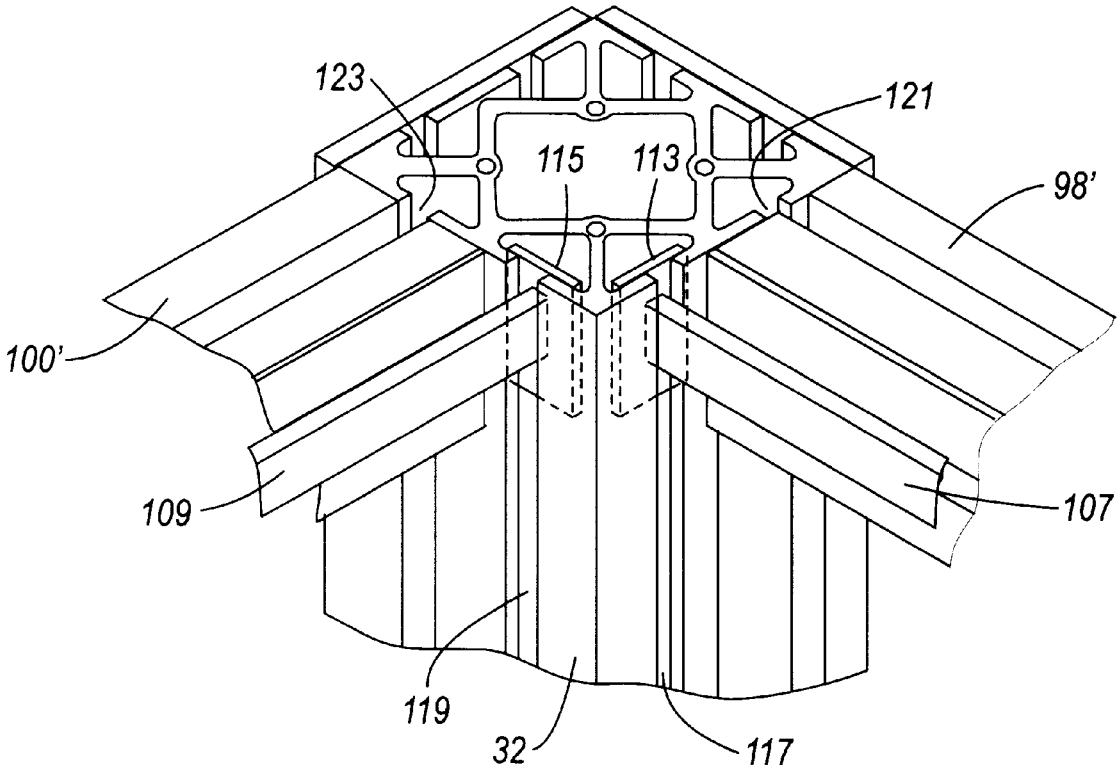

Referring further to the successive smaller and enlarged sectional perspective views of FIGS. 16 and 17, respectively, the second bracket end 113 of the compression bar 107 (as well as an additional bracket end 115 of compression bar 109) are shown engaged with first and second selected sides of the upwardly extending member 32. Specifically, inner and parallel running channels 117 and 119, of the respective pairs of parallel, spaced apart and extending channels associated with each side of the upwardly extending member 32, are illustrated in engaged fashion by the selected bracket ends 113 and 115. Additional and outwardly spaced channels 121 and 123 are illustrated, respectively, for the selected sides of the upwardly extending member 32 and in proximity to the abutting engagement with the selected ends of the cross members 98' and 100'.

Referring again to FIG. 14, bolts 125, 127, 129 and 131 are provided for establishing the compressive aspect of each of the compression bars 103, 105, 107 and 109. To this end, the enlarged head of each bolt is slidably engaged within and along a recessed channel of the cross member associated with an inwardly facing side of that member. The screw threads of the shaft extending from each bolt engages within an interiorly hollowed aperture of the associated compression bar (see at 133 in FIG. 15) at an intermediate location of the associated compression bar. Tightening of each bolt results in the vertical members being pulled in a compressing direction towards each other and so as to pinch in secure fashion therebetween the associated cross members.

Each of the compression bars (such as at 103, 105, 107 and 109) are further constructed of a stainless steel composition and so that, upon being mounted with their opposite extending brackets ends the compressing engagement created by the tightened bolts may be maintained for an indefinite period of time.

It is further understood that the compression bars may be provided in arrayed and interconnecting fashion at the uppermost end of the assembled columbarium only and/or at one or more intermediate and lower vertical locations. It is also understood that the compression bars, according to a preferred embodiment, may be located in spaced and aligning relation to each and every of the assembled crosswise extending members. It is still further understood that other suitable members can be substituted in place of the compression bars, these including flexible straps and the like.

Utilizing any one of the interconnecting variants described above, the second plurality of elongate members 70–100 are assembled in cross wise extending fashion and at selected vertical locations between the first vertically extending members 26, 28, 30 and 32 so that the resultant niche tower is constructed to be of a specified height is constructed and establishes first, second, third and fourth upwardly extending sides in cross section. The preferred embodiment of the invention also contemplates the use of an 80/20 composition of aluminum to steel for the second elongate members 70–100 (as with the four upwardly extending and first elongate extending members 26, 28, 30 and 32) and which, in combination with the webbed cross sectional configuration of the elongate members, significantly reduces the weight of the underlying tower frame without any appreciable degradation of its structural load bearing characteristics.

Each of the second members 70–100 also includes first, second, third and fourth, elongate extending faces in cross section, each of the faces further including a lengthwise extending and recessed channel formed therein. As is best illustrated once again from the enlarged partial view of FIG. 2*b* of selected cross member 78, recessed channels 114 and 116 are illustrated extending lengthwise along first and second selected faces of the four interconnecting and cross wise extending faces. While not clearly illustrated, it is understood that the recessed channels for each and every of the second cross members (again representatively illustrated at 114 and 116) may include substantially parallel side walls. Alternatively, a recessed configuration could be employed for all of the second member recessed channels 114 and 116 which is similar to that shown at 52–58 for the pairs of recessed channels formed in the selected and upwardly extending first elongate member 28. Once again, a repetitious description of the recessed channels formed within the second cross members is unnecessary beyond stating that, in the preferred embodiment, the recessed channels are all configured identically.

Furthermore, while only a single recessed channel (114 and 116 again) is illustrated for each of the four faces of the selected second crosswise extending member (78 in FIG. 2*b*), it is also understood that a pair of such recessed channels could also be formed in lengthwise extending and spaced apart fashion along each of the angled faces (such as with the upwardly extending members 26, 28, 30 and 32). It is also understood that larger pluralities of recessed channels could be employed in lengthwise extending and spaced apart fashion along both the first and/or second pluralities of elongate extending members and without departing from the scope of the present invention. Each of the second members 70–100 may be, similarly to the first elongate extending members 26, 28, 30 and 32, constructed with a webbed configuration in cross section, provided the ends of the second members support their associated and axially extending screws through a centerline of each of the second members. This would typically be accomplished, after extrusion of the second members, by installing at each of the opposite ends of each cross member, a plug of material which supports the lengthwise and projecting screw portion in an integrated and fixed manner.

Figure 6:
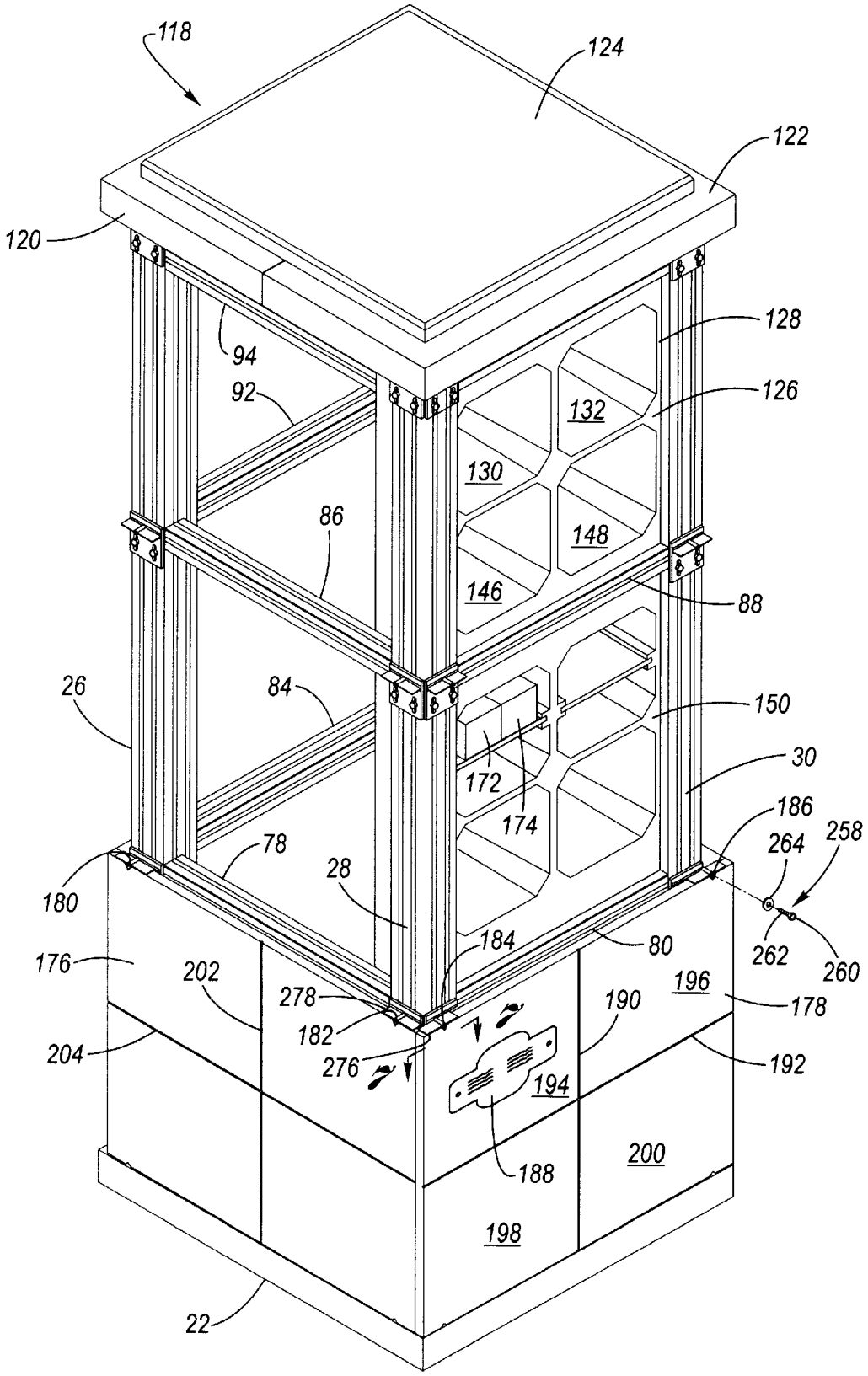
FIG. 6 is a perspective view in partially assembled fashion of the repository tower according to the instant invention and in which selected niche members are illustrated in engaged fashion between the first and second elongate extending members and with the multi-piece top assembled upon the tower.

Referring to FIG. 6, a top 118 is placed upon the upwardly extending and assembled end of the elongate members 26–32 defining the underlying framework of the tower. In a preferred embodiment, first and second planar shaped pieces 120 and 122 of fascia material, such as granite, are provided. The first 120 and second 122 pieces each have a selected thickness and are placed atop the tower in abutting fashion. A third planar shaped piece 124 of fascia material of a selected thickness is placed atop the first 120 and second 122 abuttingly engaged pieces and possesses a length and width less than a combined length and width of the first and second pieces 120 and 122 so that the top 118 may be assembled in a quick, convenient and permanent fashion and without the assembler having to lift any one single piece of extraordinary weight or dimension. It is also envisioned that other types and configurations of a top can be employed within the scope of the invention, these including also the provision of materials other than granite.

Figure 8:
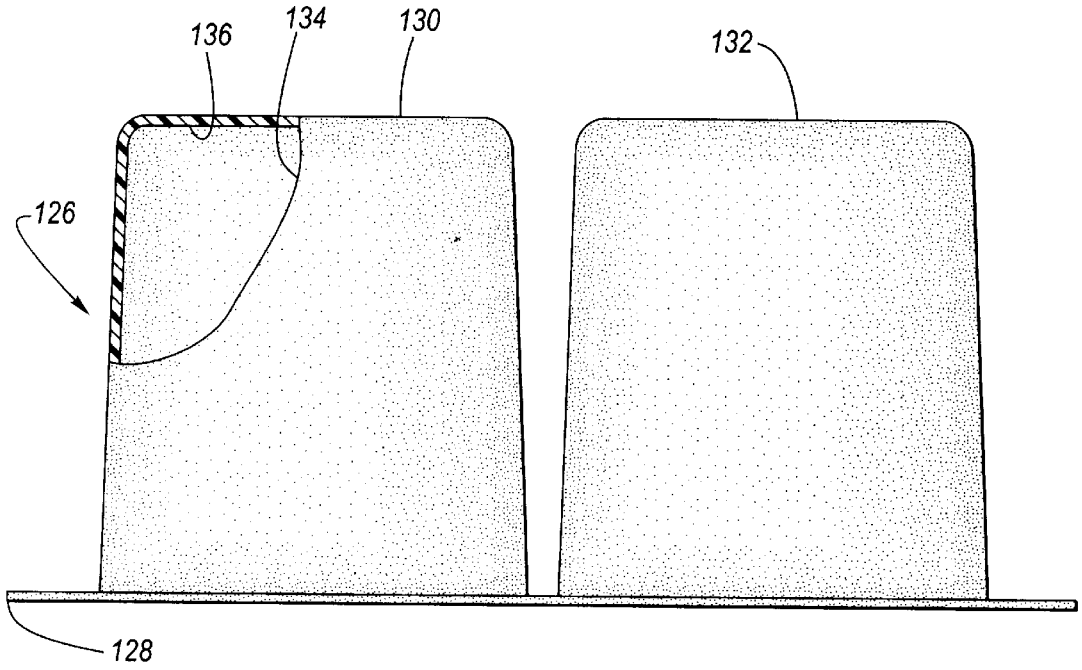
FIG. 8 is a side view, in partially cutaway fashion, of a first sub-plurality of niche members according to the present invention.
Figure 9:
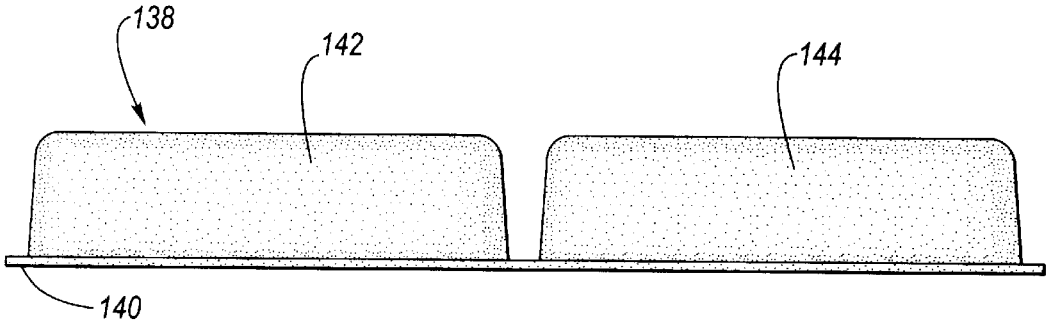
FIG. 9 is a side view of a second sub-plurality of niche members according to the present invention.
Figure 10:
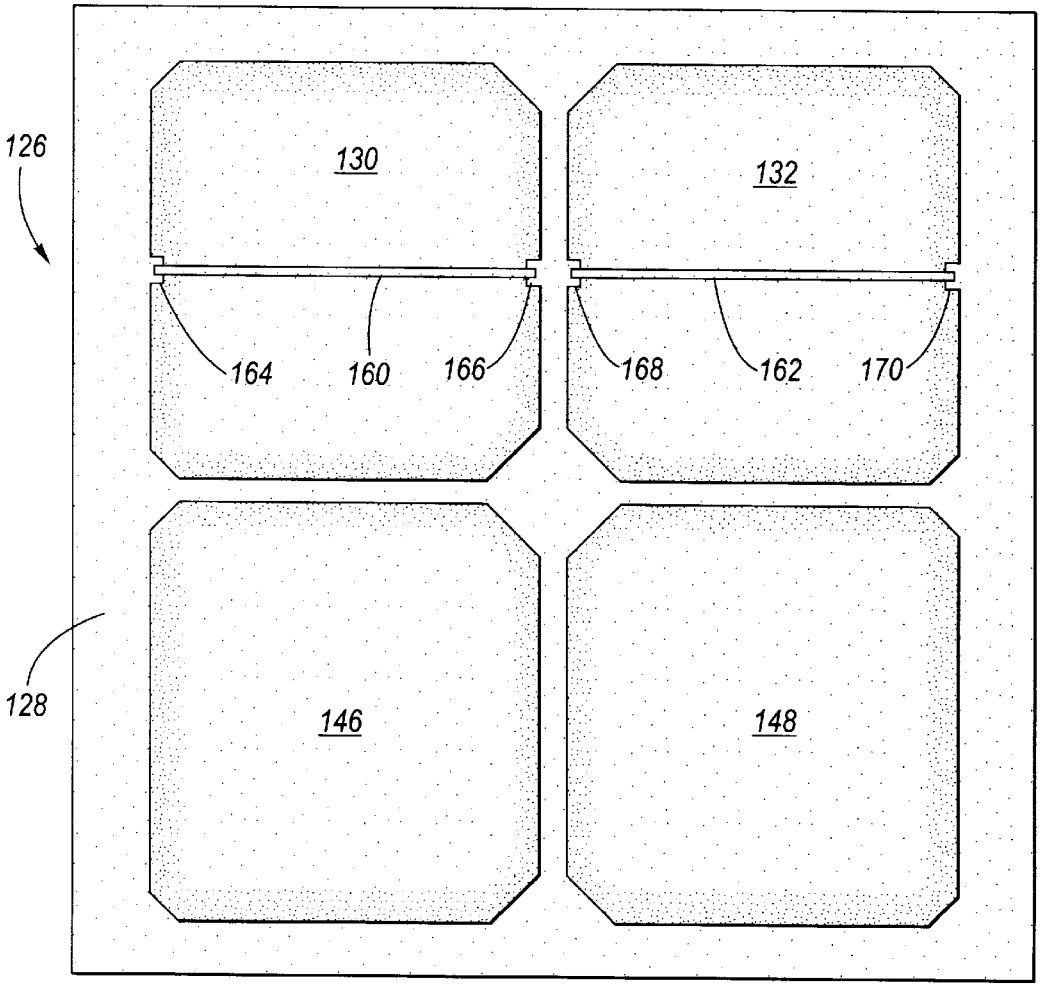
FIG. 10 is a front view applicable to either the first or second sub-pluralities of niche members and further illustrating the peripherally extending lip for insertingly engaging selected recessed channels of the first and second elongate extending members, individual receptacle portions, and the shelf slidably engageable within individual receptacle portions for further subdividing the receptacle portions.

Referring to FIGS. 8, 9 and 10, a plurality of niche members are provided, according to first and second recessed depth configurations in the primary embodiment, and which are engageable with each of four upwardly extending sides established by the constructed tower for accomplishing the interment of individual quantities of burial remains. Referring first to FIG. 8, a niche member is illustrated at 126 according to a first sub-plurality of the niche members. The niche member 126 includes a substantially rectangular outline defined by a peripherally extending lip 128. The niche member represented at 126 also includes first, second, third and fourth individual receptacle portions (only first and second of which are illustrated at 130 and 132 in the side illustration of FIG. 8) which are formed within the central body of the niche member and which are further of a selected depth. Reference is also made to the cutaway illustrated at 134 in FIG. 8 and which shows the plasticized material construction 136 of the niche member 128.

Referring to FIG. 9, a niche member is illustrated at 138 according to a second subplurality of such members and which likewise includes a substantially rectangular outline defined by a peripherally extending lip 140. The niche member represented at 138 also includes first, second, third and fourth individual receptacle portions (only first and second of which are illustrated at 142 and 144 in the side illustration of FIG. 9) which are formed within the central body of the niche member and which are of a further selected depth which is significantly less than that illustrated at 130 and 132 for the niche member 126 selected from the first sub-plurality of niche members.

FIG. 10 illustrates a front end view of a niche member which is identical for either of the two selected sub-pluralities 126 and 138. For the sake of convenience, FIG. 10 will be treated as describing a niche member 126 selected from the first and larger sub-plurality. It is however understood that any of the second sub-plurality 138 are identically described by the frontal illustration of FIG. 10. In FIG. 10, the niche member 126 is illustrated to include the first 130, second 132, third 146 and fourth 148 receptacle portions recessed inwardly in the central body portion of the niche member 126 and from the associated side of the tower to which it is subsequently secured.

As is illustrated in the perspective view of FIG. 6, opposite and vertically extending edges of the peripheral lip the niche member 126, and an identically configured and further niche member 150, are slidably engaged between the selected and lengthwise extending and recessed channels of the first elongate members 28 and 30 along a selected side. Likewise, opposite and horizontally extending edges of the lips are received within the recessed channel formed along the face of each second elongate members (in FIG. 6 see particularly cross members 80 and 88 associated with the side within which is slidably engaged the niche members 126 and 150).

Figure 11:
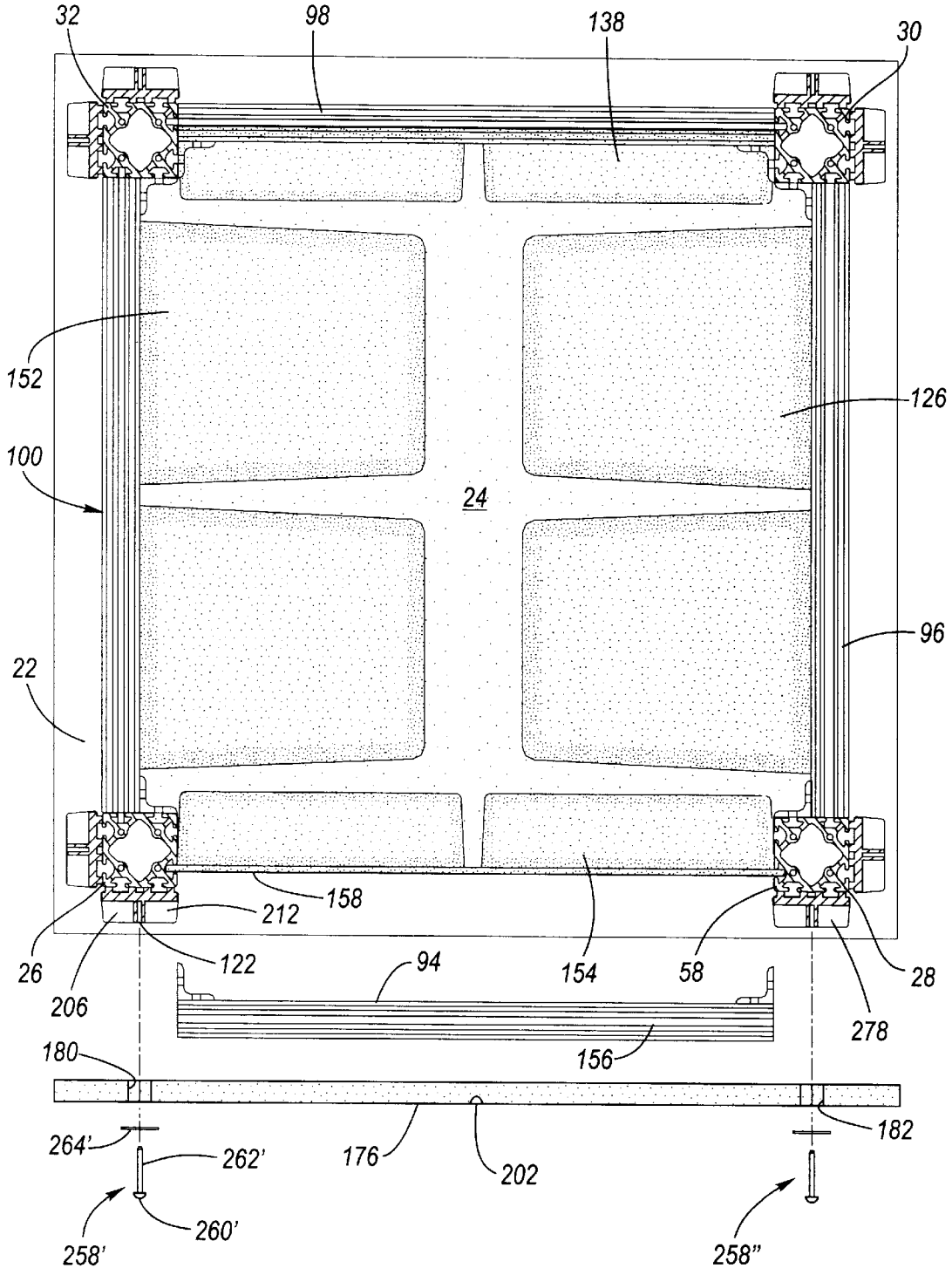
FIG. 11 is an exploded top view, similar in regards to that illustrated in FIG. 5, and illustrating the first and second sub-pluralities of niche members assembled along the four sides of the tower with space maximization accounted for by the variations in depth of the receptacle portions.

As is further illustrated in the open top and exploded view of FIG. 11, niche members according to both the first and second sub-plurality configurations are illustrated in slidably engaged fashion within each of the four assembled sides of the niche tower. Specifically, the niche member 126 according to the first selected sub-plurality is once again illustrated in nestling engagement between the upwardly extending elongate members 28 and 30 and the horizontally extending, spaced apart and cross wise extending members 88 and 96. An additional and identically configured niche member is illustrated at 152 and engages between the vertically extending members 26 and 32, as well as the horizontally extending and assembled cross wise members 92 and 100 (see also perspective of FIG. 6).

To further maximize the available internal space defined within the assembled niche tower, and which is clearly evident upon viewing FIGS. 6 and 11 in combination, additional niche members according to the second and shorter recessed depth sub-plurality are provided at 138 and again at 154. Specifically, the niche member 138 according to the second selected sub-plurality is illustrated in nestling engagement between the upwardly extending elongate members 30 and 32 and the horizontally extending, spaced apart and cross wise extending members 90 and 98 (refer also to perspective of FIG. 2). The additional and identically configured niche member is illustrated again at 154 and engages between the vertically extending members 26 and 28, as well as the horizontally extending and assembled cross wise members 86 and 94. The cross member 94 is illustrated in exploded fashion in FIG. 11 and in which a recessed channel 156 configured within an associated cross sectional face is suitable for insertingly receiving the corresponding peripheral extending edge of the lip for contributing in securing the niche member in place, along with the selected recessed channel 58 (previously illustrated in FIG. 12 for upwardly extending member 28) and an additional and selected recessed channel 158 of the first upwardly selected member 26.

In this manner, the overall internal space of the assembled tower is utilized to its maximum by providing the additional and smaller recessed depth niche members (such as again are shown at 138 and 154 in FIG. 11) for the third and fourth sides of the tower and in additional to the larger recessed depth niche members 126 and 152 provided on the first and second sides. Referring again to FIGS. 6 and 10, a shelf may be slidably and inwardly engaged with opposite sides of each of the individual receptacle portions and at selected intermediate locations, the purpose for which is to provide additional storage capacity for interred burial remains. Referring further to FIG. 10, an example is illustrated by shelves 160 and 162 slidably engaged, respectively, between reception channels 164 and 166 (associated with intermediate side locations of the first selected receptacle portion 130) and between reception channels 168 and 170 (associated with intermediate side locations of the second selected receptacle portion 132). Crematorium remains containers at 172 and 174 in the further perspective view of FIG. 6 further illustrate how the storage capacity of the individual niche members can be additionally increased. As previously explained, it is further understood that like shelves 160 and 162 of reduced depth can be employed with the second or side plurality of niche members (such as again is shown at 138) for increasing the holding capacity along the third and fourth sides of the assembled tower.

Referring again to FIG. 6, a plurality of individual covering fascia pieces are secured to each of the four sides of the tower in overlaying fashion relative to their associated niche members and for the purpose of sealing the niche members and their interred burial remains. In FIG. 6, only first 176 and second 178 such fascia pieces are illustrated. It is however understood that a plurality of such pieces are provided and which are secured to their associated sides of the niche tower so as to overlay and enclose the installed niche members. The fascia pieces, such as again at 176 and 178, are further constructed of a granite or like decorative material (⅞" of an inch thick in a preferred variant so as to maximize effect and weight reduction). Each of the fascia pieces are further formed with "V" shaped notches within upper and lower edges thereof. Reference is made to upper edge notches 180 and 182 in fascia piece 176 and upper edge notches 184 and 186 in fascia piece 178.

As is further illustrated in FIG. 6, a decorative covering plate or indicia 188 may be secured to the exterior facing surface of the fascia piece at a suitable location to overlay interred burial remains. The fascia piece (again 178) may also be provided with exteriorly scored lines 190 and 192 which define an intersecting grid and which serve to subdivide the interior of fascia piece into individual interment locations 194, 196, 198 and 200 to correspond to the placement and dimension of the inwardly recessed and remain holding receptacle portions of the associated niche member slidably and mountably engaged within the assembleable framework. Referring also to the top exploded view of FIG. 11, the fascia piece is illustrated at 176 and the configuration of a vertically extending score line 202 is better shown (consistent again with the view of FIG. 6) and in combination with an additional such and intersecting score line 204 for subdividing the fascia piece 176 likewise into four individual compartments associated with the four underlaying receptacle portions of the installed niche member.

Figure 4:
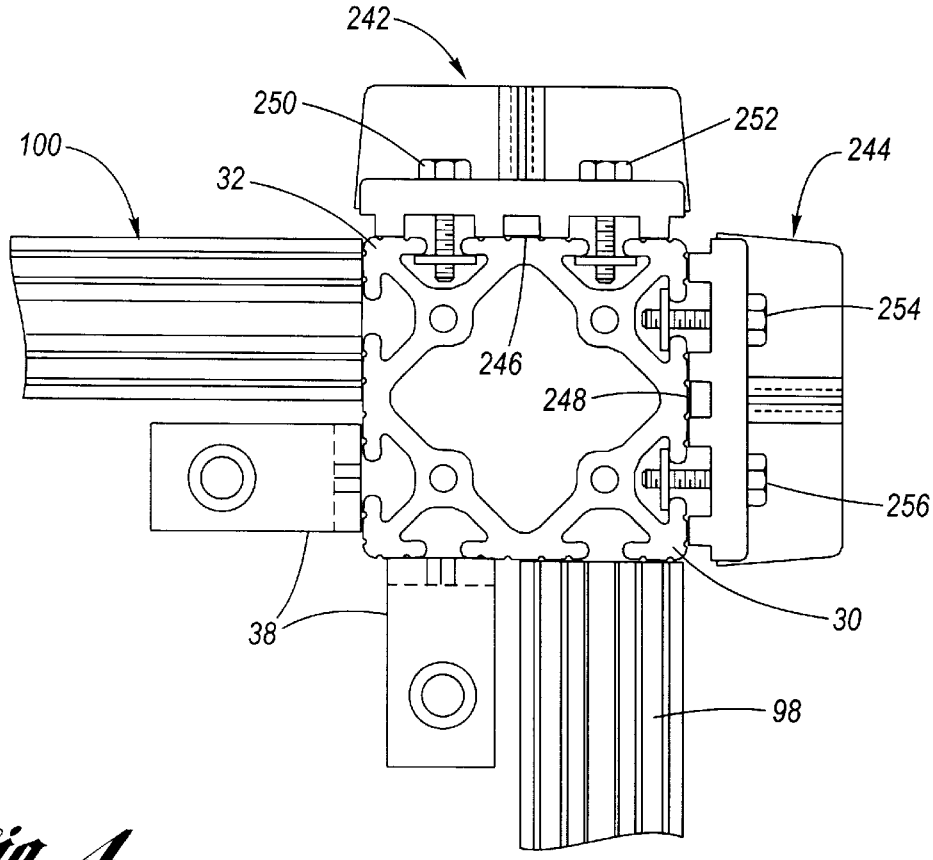
FIG. 4 is an enlarged top end view taken along line 4—4 of FIG. 3 and further illustrating both the use of the angled brackets for reinforcing the engagement between the vertical and horizontally extending members as well as the webbed configuration of the selected vertical member illustrated in cross section.

Referring again to the several views, and most notably FIGS. 2*a* and 2*b*, mounting plates are provided at specified vertical locations to planar and spaced apart faces of the first extending members for securing the individual pieces of fascia covering, such as at 176 and 178, to the sides of the assembleable tower. As is illustrated in FIGS. 2*a* and 2*b*, a specified mounting plate 206 is representatively shown and which is secured to associated face 208 of the first upwardly extending member 26. Referring further to FIGS. 2 and 4 in combination, a plurality of individual and identically constructed mounting plates are illustrated mounted to the adjoining and outward extending faces of each of the first 26, second 28, third 30 and fourth 32 upwardly extending elongate members at specified vertical locations to the first elongate members. Accordingly, a repetitive description and identification of each mounting plate is rendered unnecessary.

Referring again to FIGS. 2*a* and 2*b*, the mounting plate 206 further a main plate portion 210 and a perpendicularly and horizontally extending flange 212. The flange of each succeeding mounting plate defines, in combination, upper and lower succeeding abutment shoulders for locating and facilitating the mounting of the individual pieces of covering fascias associated with selected niche members. As best shown in FIG. 2*b*, first 214 and second 216 vertical slots are formed through the main plate 210 in spaced apart fashion and such that the slots 214 and 216 align with selected portions of first 218 and second 220 axially extending channels formed in the associated face 208 of the first upwardly extending member 26. The extending flange 212 further includes an integrally formed sleeve portion 222 having an open end 224 and within which are defined interiorly placed threads.

Twist and lock fasteners 226 and 228 are provided for securing the mounting plate 206 to the associated face 208 of the upwardly extending member 206 and each include a head (230 and 232), an integrally extending shaft (234 and 236) and an elongate configured gripping portion (238 and 240) secured to the shaft at a selected location. The gripping portions 238 and 240 of the illustrated fasteners 226 and 228 are inserted through the aligning vertical slots 214 and 216, and their associated channels 218 and 220, prior to the fastener heads 232 and 234 being rotated approximately 90° so that the gripping portions 238 and 240 biasingly engage against the inwardly contoured surfaces of the recessed channels 218 and 220 to lockingly engage the mounting plate 206 to the face 208 of the associated first elongate member 26. As is also illustrated in the top and sectional end view of FIG. 4, additional and identically configured mounting plates 242 and 244 are illustrated mounted to adjoining and outward extending surfaces 246 and 248 of the elongate and upwardly extending member 32 by virtue of additional pairs of twist and lock fasteners 250, 252 and 254, 256.

Mounting bolts are provided for fixedly securing the selected decorative fascia pieces in place over their associated niche members and at the outline locations illustrated, by example, by the "V" shaped notches 180, 182, 184 and 186 formed in the decorative fascia pieces 176 and 178. As best illustrated in FIG. 6, a mounting bolt 258 is provided with a head 260 and an exteriorly threaded shaft 262. A washer 264 is slidably engaged upon the exteriorly threaded shaft 262 of the selected mounting bolt 258 and, upon tightening of the exteriorly threaded shaft portion within the associated interiorly threaded sleeve portion (see by example again at 222 and 224 in FIG. 2*b*) the washer 264 and bolt head 260 are compressed against exterior facing surfaces of the fascia coverings in the vicinity of the extending edge and the "V" shaped notches which accommodate the configuration of the sleeve portion. Also illustrated in the top end view of FIG. 11 is an identical bolt 258' with a head 260', shaft 262' and slidably engageable washer 264' for illustrating from another angle the fastening of the decorative fascia piece 176 to the mounting plate 206 along one specified edge connection. Along an opposite upper edge of the fascia piece 176 is a further and identical bolt 258" for engaging the piece 176 (proximate its additional "V" notched portion 182) to the additional mounting plate 278.

Figure 7:
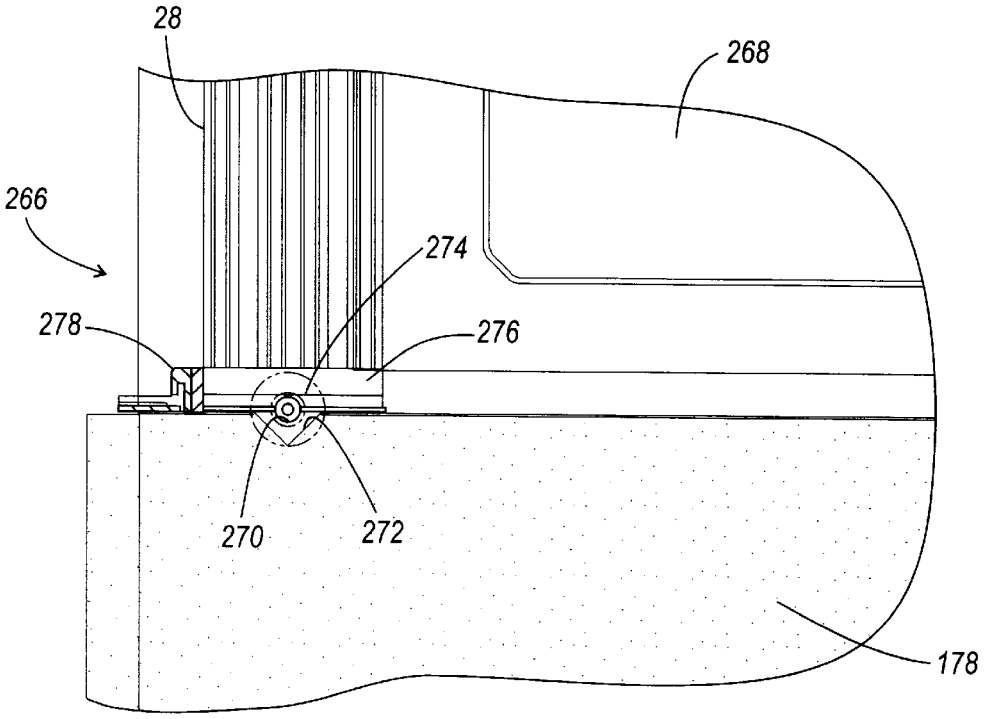
FIG. 7 is an enlarged sectional view taken along line 7—7 of FIG. 6 and illustrating from one angle the manner in which a piece of covering fascia is held in abutting and located fashion against a selected side of the assembled tower.

Referring further to FIG. 7, a view illustrates at 266, from one angle, the manner in which a piece of covering fascia 268 is held in abutting and located fashion against a selected side of the assembled tower and in elevated fashion above another covering fascia, in this instance fascia piece 178 also illustrated in FIG. 6. Also shown in phantom are representations of a mounting bolt head 270 and sandwiching washer 272 for engaging within an associated sleeve portion 274 of a mounting plate 276. Viewing FIG. 6 in combination with FIG. 7, another mounting plate is illustrated at 278 secured to an adjoining and outwardly extending face of the upwardly extending member 28.

Figure 5:
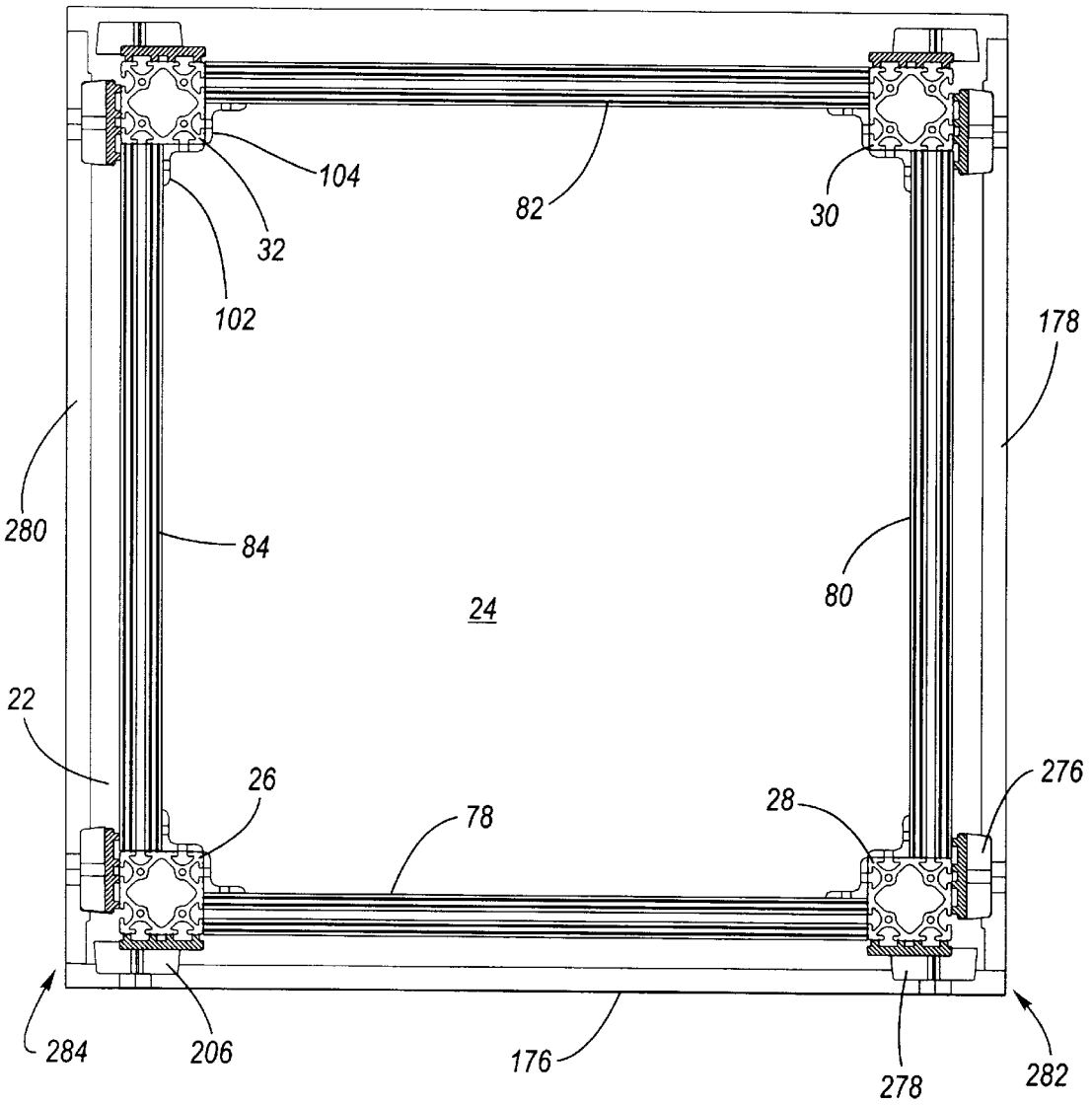
FIG. 5 is an enlarged top view taken along line 5—5 of FIG. 2 and illustrating selected fascia coverings engaged upon first, second and third selected sides of the assembled frame of the tower according to the present invention.

Reviewing FIGS. 5 and 11 in combination, open top end views are shown of the manner in which the covering fascia pieces are secured in flush, end to end and abutting fashion so as to provide the assembled niche tower with a flush appearance about its periphery. As is specifically seen in the assembled top end view of FIG. 5 (viewed in combination with FIG. 6) illustrates fascia covering pieces 176 and 178 secured along adjoining sides of the assembled niche tower along with a further piece 280 secured along a third side. Illustrated further still at 282 and 284 are the flush vertical edge alignments of the fascia pieces 176 to 178 and 176 to 280, respectively.

It is therefore readily understood that the present invention teaches a quickly and easily assembleable crematorium niche repository tower for holding individual quantities of burial remains in an aesthetically dignifying and permanent fashion. The advantages imparted by the assembleable repository tower of the present invention again include the strength and relatively lightweight of the assembleable components, as well as the provision of additional and variable covering fascia to adapt the look and presentation of the tower to specific tastes.

Having described my invention, additional preferred embodiments will become apparent to those skilled in the art to which it pertains and without deviating from the scope of the appended claims.

I claim:

1. An assembleable repository tower for holding individual quantities of burial remains, comprising:

a platform base;

a first plurality of elongate members, each of said first plurality of members having first end engaged with said platform base and a second upwardly extending end, each of said first plurality of members further defining a plurality of elongate extending faces in cross section;

a second plurality of elongate members, each of said second plurality of members having first and second oppositely extending ends secured to selected faces of first and second selected members of said first plurality of members, said second plurality of members each further defining a plurality of elongate extending faces in cross section;

said plurality of elongate extending faces of said first and second pluralities of elongate members each further comprising at least one lengthwise extending and recessed channel;

said first and second pluralities of elongate members being assembled so that said tower is of a specified height and establishes a plurality of sides in cross section;

a plurality of niche members engageable with at least one of said plurality of sides established by said tower, each of said niche members defining at least one receptacle portion recessed inwardly from said associated side and suitable for holding a quantity of burial remains; and a plurality of individual covering fascia secured to each of said sides of said tower for sealing said niche members and burial remains, each of said covering fascia capable of being disengaged from said tower to reveal selected niche members.

2. The repository tower according to claim 1, each of said elongate extending faces associated with said first plurality of members further comprising first and second spaced apart and axially extending channels.

3. The repository tower according to claim 1, each of said second plurality of elongate members further comprising an axially extending screw extending from each opposite end, said screws being aligned with selected recessed channels of said first elongate members, said second members each being rotated in a tightening direction and about an axial centerline thereof to fastenably engage in cross wise extending fashion between selected pairs of said first elongate members.

4. The repository tower according to claim 3, further comprising the installation, at selected locations, of angled brackets for reinforcing the engagement between said first and second pluralities of elongate members.

5. The repository tower according to claim 1, further comprising a top placed upon said upwardly extending end of said assembled elongate members defining said tower.

6. The repository tower according to claim 5, said top further comprising first and second planar shaped pieces of fascia material, each having a selected thickness and placed in abutting engagement, a third planar shaped piece of fascia material having a selected thickness and placed atop said first and second abuttingly engaged pieces, said third piece having a length and width less than a combined length and width of said first and second pieces.

7. The repository tower according to claim 6, said first, second and third pieces of fascia material, as well as said individual covering fascia associated with said sides of said tower, being constructed of a granite material.

8. The repository tower according to claim 1, each of said niche members further comprising a substantially rectangular outline which is defined by a peripherally extending lip, said at least one receptacle portion further comprising first, second, third and fourth individual receptacle portions arranged in horizontally and vertically spaced apart fashion.

9. The repository tower according to claim 8, said assembled tower comprising first, second, third and fourth sides in cross section, said plurality of niche members further being divided into a first sub-plurality with receptacle portions each having a first selected depth and a second sub-plurality with receptacle portions each having a second selected depth lesser in dimension than those of said first sub-plurality, said first plurality of niche members being engaged with first and second opposite and upwardly extending sides of said tower, said second plurality of niche members being engaged with third and fourth opposite and upwardly extending sides, the configuration of said receptacle portions permitting the interment of burial remains within all four sides of said tower in a space-maximizing manner.

10. The repository tower according to claim 9, further comprising a shelf slidably and inwardly engaging with opposite sides defining each of said individual receptacle portions and at selected intermediate locations, said shelf further subdividing said associated receptacle portion and providing yet additional interment capacity for burial remains.

11. The repository tower according to claim 2, further comprising locating and mounting means for securing said individual covering fascia to said sides of said tower.

12. The repository tower according to claim 11, said locating and mounting means further comprising mounting plates secured at specified vertical locations to planar and spaced apart faces of selected pairs of said first elongate members and which define each of said plurality of sides of said tower, each of said mounting plates further comprising a perpendicularly and horizontally extending flange, said flanges in combination defining upper and lower abutment shoulders for individual pieces of covering fascias associated with selected niche members.

13. The repository tower according to claim 12, further comprising first and second vertical slots formed through each of said mounting plates in spaced apart fashion and such that said slots align with selected portions of said first and second axially extending channels in said associated faces of said first extending members, twist and lock fasteners are provided, each including a head, an integrally extending shaft and an elongate configured gripping portion secured to said shaft at a selected location, said gripping portion of each selected fastener being inserted through said aligning vertical slot and said channel prior to said fastener head being rotated to lockingly engage said mounting plate to said face of said associated first elongate member.

14. The repository tower according to claim 12, said perpendicularly and horizontally extending flange of each mounting plate further comprising an interiorly threaded sleeve portion integrally formed with said flange such that, upon location of a selected one of said covering fascias between upper and lower pairs of mounting plates, a mounting bolt with a head and an exteriorly threaded shaft is engaged with said interior threads of a selected integral sleeve portion to secure said associated fascia in place.

15. The repository tower according to claim 14, each of said individual pieces of covering fascia further comprising "V" shaped notches formed within upper and lower edges thereof and in aligning location with said sleeve portions of said mounting plates, a washer being slidably engaged upon said exteriorly threaded shaft of said mounting bolt and, upon tightening of said bolt within said associated sleeve portion, is sandwiched between said bolt head and said notch in said fascia edge.

16. The repository tower according to claim 1, further comprising a plurality of angled floor plates for engaging said first ends of said first plurality of elongate members upon an upwardly facing surface of said platform base.

17. The repository tower according to claim 1, at least one of said first and second pluralities of elongate members each further comprising a webbed portion as viewed in cross section and which defines an axially extending and substantially hollowed interior.

18. The repository tower according to claim 17, each of said first and second plurality of elongate members further being constructed of an 8020 aluminum extrusion.

19. The repository tower according to claim 1, further comprising substantially "L" shaped and angled brackets for engaging said oppositely extending ends of each of said second elongate members to said first upwardly extending elongate members, said brackets each further including a first bolt for fastening a first extending leg of said angled bracket to a selected channel in said upwardly extending member, a second bolt securing an interconnected and further angled leg to a selected channel extending along said second member.

20. The repository tower according to claim 1, further comprising a plurality of elongate and crosswise extending compression bars for engaging said second elongate members to said first upwardly extending members.

21. The repository tower according to claim 20, each of said compression bars further including a first bracket end and a second opposite bracket end, said first bracket end engaging a selected channel in a first selected and upwardly extending member, said second bracket end engaging a selected channel in a second selected and upwardly extending member.

22. The repository tower according to claim 21, further comprising a bolt for transferring compressive forces from each of said compression bars to said associated upwardly extending members to draw said upwardly extending members inwardly against each other and in opposition to said second elongate members.

23. The repository tower according to claim 22, further comprising said bolt for supporting each of said compression bars at an intermediate and crosswise extending location to an associated and second elongate extending member.

24. An assembleable repository tower for holding individual quantities of burial remains, comprising:

a platform base;

a first plurality of elongate members, each of said first plurality of members having first, second, third and fourth elongate extending faces in cross section, a first end engaged with said platform base and a second upwardly extending end, each of said first plurality of members further including a webbed configuration as viewed in cross section and which defines and axially extending and substantially hollowed interior;

a second plurality of elongate members, each of said second plurality of members having first and second oppositely extending ends secured to selected faces of first and second selected members of said first plurality of members, said second plurality of members each further defining first, second, third and fourth, elongate extending faces in cross section;

said first and second pluralities of elongate members being assembled so that said tower is of a specified height and establishes first, second, third and fourth upwardly extending sides in cross section;

a plurality of niche members engageable with each of said upwardly extending sides established by said tower, each of said niche members including a plurality of receptacle portions recessed inwardly from said associated side and suitable for holding a quantity of burial remains; and a plurality of individual covering fascia secured to each of said sides of said tower for sealing said niche members and burial remains, each of said covering fascia capable of being disengaged from said tower to reveal selected niche members.

25. An assembleable repository tower for holding individual quantities of burial remains, comprising:

a platform base having a selected thickness and an upwardly facing surface;

a first plurality of elongate members, each of said first plurality of members having first, second, third and fourth elongate extending faces in cross section, each of said faces further including at lest one lengthwise extending and recessed channel formed therein, a first end of each member engaging with said platform base and a second end extending upwardly, each of said first plurality of members further including a webbed configuration as viewed in cross section and which defines and axially extending and substantially hollowed interior;

a second plurality of elongate members, each of said second plurality of members having first and second oppositely extending ends from which project axially extending screws, said screws being aligned with said recessed channels of a selected pair of spaced apart first elongate members, said second member being rotated in a tightening direction to secure said second members in a cross wise extending fashion between said pair of first elongate members, said second plurality of members each further defining first, second, third and fourth, elongate extending faces in cross section, each of said faces further including a lengthwise extending and recessed channel formed therein;

said first and second pluralities of elongate members being assembled so that said tower is of a specified height and establishes first, second, third and fourth upwardly extending sides in cross section;

a plurality of niche members engageable with each of said upwardly extending sides established by said tower, each of said niche members including a substantially rectangular outline defined by a peripherally extending lip, opposite and vertically extending edges of said peripheral lip slidingly engaging between selected lengthwise extending and recessed channels of said first elongate members, opposite and horizontally extending edges of said lip being received within said recessed channel of said second elongate members, each of said niche members further including first, second, third and fourth receptacle portions recessed inwardly from said associated side and suitable for holding a quantity of burial remains; and a plurality of individual covering fascia secured to each of said sides of said tower for sealing said niche members and burial remains, each of said covering fascia capable of being disengaged from said tower to reveal selected niche members.

26. An assembleable repository tower for holding individual quantities of burial remains, comprising:

a platform base;

a first plurality of elongate members, each of said first plurality of members having a first end engaged with said platform base and a second upwardly extending end, a plurality of angled floor plates engaging said first ends of said first plurality of elongate members upon an upwardly facing surface of said platform base, each of said first plurality of members further defining a plurality of elongate faces in cross section;

a section plurality of elongate members, each of said second plurality of members having first and second oppositely extending ends secured to selected faces of first and second members of said first plurality of members, said second plurality of members each further defining a plurality of elongate extending faces in cross section;

said first and second pluralities of elongate members being assembled so that said tower is of a specified height and establishes a plurality of sides in cross section;

a plurality of niche members engageable with at least one of said plurality of sides established by said tower, each of said niche members defining at least one receptacle portion recessed inwardly from said associated side and suitable for holding a quantity of burial remains; and a plurality of individual covering fascia secured to each of said sides of said tower for scaling said niche members and burial remains, each of said covering fascia capable of being disengaged from said tower to reveal selected niche members.

27. An assembleable repository tower for holding individual quantities of burial remains, comprising:

a platform base;

a first plurality of elongate members, each of said first plurality of members having a first end engaged with said platform base and a second upwardly extending end, each of said first plurality of members further defining a plurality of elongate extending faces in cross section;

a second plurality of elongate members, each of said second plurality of members having first and second oppositely extending ends secured to selected faces of first and second selected members of said first plurality of members, said second plurality of members each further defining a plurality of elongate extending faces in cross section;

at least one of said first and second pluralities of elongate members each further comprising a webbed portion as viewed in cross section and which defines an axially extending and substantially hollowed interior;

said first and second pluralities of elongate members being assembled so that said tower is of a specified height and establishes a plurality of sides in cross section;

a plurality of niche members engageable with at least one of said plurality of sides established by said tower, each of said niche members defining at least one receptacle portion recessed inwardly from said associated side and suitable for holding a quantity of burial remains; and a plurality of individual covering fascia secured to each of said sides of said tower for sealing said niche members and burial remains, each of said covering fascia capable of being disengaged from said tower to reveal selected niche members.

* * * * *